US006703195B2

(12) United States Patent
Ochiai

(10) Patent No.: US 6,703,195 B2
(45) Date of Patent: Mar. 9, 2004

(54) SILVER HALIDE EMULSION, AND COLOR PHOTOGRAPHIC LIGHT-SENSITIVE MATERIAL AND IMAGE FORMING METHOD USING THE SAME

(75) Inventor: Yoshiro Ochiai, Minami-Ashigara (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/449,402

(22) Filed: Jun. 2, 2003

(65) Prior Publication Data

US 2003/0232293 A1 Dec. 18, 2003

Related U.S. Application Data

(62) Division of application No. 09/966,287, filed on Oct. 1, 2001.

(30) Foreign Application Priority Data

Sep. 29, 2000 (JP) ..... 2000-298475

(51) Int. Cl.[7] ..... G03C 1/09

(52) U.S. Cl. ..... 430/567; 430/604

(58) Field of Search ..... 430/567, 604

(56) References Cited

U.S. PATENT DOCUMENTS 4,804,621 A 2/1989 Tufano et al.
H1608 H * 11/1996 Nishio et al. ..... 430/264
5,919,611 A 7/1999 Maruyama

* cited by examiner

*Primary Examiner*—Hoa Van Le
(74) *Attorney, Agent, or Firm*—Sughrue Mion, PLLC

(57) ABSTRACT

A silver halide emulsion formed of high silver chloride particles, the high silver chloride particles having a continuous outermost layer containing at least 30 mol % of silver bromide, the high silver chloride particles having a silver chloride content of at least 95 mol % and a silver iodide content of 0.05 mol % to 0.75 mol %, wherein the outermost layer has a center portion, the center portion being limited to a region within 10% to 90% of the volume of the outermost layer, the center portion having present therein a compound of a metal from column VIII of the periodic table.

11 Claims, 1 Drawing Sheet

SILVER HALIDE EMULSION, AND COLOR PHOTOGRAPHIC LIGHT-SENSITIVE MATERIAL AND IMAGE FORMING METHOD USING THE SAME

This is a divisional of application Ser. No. 09/966,287 filed Oct. 1, 2001; the disclosure of which is incorporated herein by reference.

BACKGROUND OF THE INVENTION

1. Field of the Invention

The present invention relates to a silver halide emulsion containing high silver chloride particles including silver iodide, particularly, high silver chloride tabular particles and further high silver chloride tabular particles having a {111} plane as a principal plane (hereinafter referred to as {111} high silver chloride tabular particle). The present invention also relates to a color photographic light-sensitive material and an image forming method using the silver halide emulsion. The present invention relates, particularly, to an emulsion which has excellent grain shape stability, in which there is little the increase of fogging after a coating solution is dissolved and aged, and has high sensitivity and excellent reciprocity properties (especially, exposure at high illuminance). Also, the present invention relates to a color photographic light-sensitive material using such an emulsion and to a method of forming an image on the color photographic light-sensitive material, and, particularly, to a method of forming an image by exposure performed at high illuminance in a short period of time.

2. Description of Related Art

As a method of forming a tabular silver halide emulsion particle having a {111} principal plane, methods of forming a particle in the presence of a crystal habit control agent comprising, for example, aminoazaindene, triaminopyrimidine, hydroxyaminoazine, thiourea, xanthonoid and a pyridinium salt are disclosed in, for example, U.S. Pat. Nos. 4,400,463, 5,185,239 and 5,176,991, Japanese Patent application Laid-Open (JP-A) No. 63-213836 and U.S. Pat. Nos. 5,176,992 and 5,691,128 respectively.

It is well-known in the fields concerned that, in high silver chloride particles, the {100} plane has tended to appear selectively so that the high silver chloride particles generally have a cubic form. In the above patents, the originally unstable {111} plane is made to appear externally by the crystal habit control agent to form the tabular particle. Therefore, the high silver chloride {111} tabular particle is redissolved immediately after the crystal habit control agent falls away from the surface of the particle, leading to the emergence of the {100} plane, so that the form of the {111} particle cannot be kept. Also, high sensitization by spectral sensitization and chemical sensitization cannot be expected without the fall of the crystal habit control agent.

U.S. Pat. No. 5,691,128 discloses that the adhesion of a crystal habit control agent is controlled by the pH to adsorb a sensitizing dye and the crystal habit control agent such that the both are exchangeable with each other, thereby making shape stability and high sensitization compatible with each other.

Also, U.S. Pat. No. 5,272,052 discloses that silver bromide is selectively formed on the top of particles by epitaxial growth utilizing the adsorption of a crystal habit control agent, and thereafter a photographically useful compound is exchanged with the crystal habit control agent and adsorbed, whereby complex particles consisting of a host and an epitaxial portion can be formed.

However, in a state in which the crystal habit control agent has fallen away, shape and pigment adsorbing conditions in these epitaxial particles changes moment by moment after spectral sensitization and chemical sensitization, and eventually after coating and aging of the coating solution, whereby increase in fogging becomes marked and no epitaxial particles that can be put to use are obtained.

It is generally said in the fields concerned that if a high silver chloride particle is doped with a the compound of a metal from column VIII of the periodic table which metal is represented by iridium, high illuminance reciprocity is improved. However, this is limited to cases in which a sufficient amount of time has lapsed from exposure until development processing. When the amount of time that has lapsed from exposure until development processing is short, there is an increase in the dependency of sensitivity (gradation) on time, and the sensitivity is low (soft). Thus, this does not amount to a measure for improvement. Therefore, in JP-A No. 64-26837, JP-A No. 5-61136, JP-A No. 6-35147, JP-A No. 11-109534, U.S. Pat. Nos. 5,284,745, 5,391,471, 5,415,991, 5,043,256, 5,627,020 and 5,356,770 and European Pat. No. 0568091A, many methods are disclosed in which a silver bromide localized phase is provided in a high silver chloride particle, and the localized phase is intensively doped with a metal compound, whereby high illuminance reciprocity and the dependency of sensitivity on time from exposure until development processing is improved. Particularly in JP-A No. 11-109534, an even greater effect of improvement is achieved by limiting doping of the iridium to within the silver bromide localized phase. However, this doping technique relates to doping the inside of the silver bromide epitaxial, and the shapes of epitaxial particles in the case of {111} high silver chloride tabular particles are unstable. In particular, increased fogging resulting from dissolution and aging of the coating solution cannot be suppressed.

SUMMARY OF THE INVENTION

It is an object of the present invention to provide a high silver chloride emulsion including silver iodide to control increase in fogging after a coating solution is dissolved and aged, with which high silver chloride emulsion sensitivity and contrast and illumination reciprocity are improved. In particular, it is an object of the present invention to provide a {111} high silver chloride tabular particle emulsion, a photographic light-sensitive material and an image forming method that each use the {111} high silver chloride tabular particle emulsion.

The inventors of the present invention have found that the above problem can be efficiently solved by using the following means.

Accordingly, the present invention provides a silver halide emulsion comprising high silver chloride particles, the high silver chloride particles having a continuous outermost layer containing at least 30 mol % of silver bromide, the high silver chloride particles having a silver chloride content of at least 95 mol % and a silver iodide content of 0.05 mol % to 0.75 mol %, wherein the outermost layer has a center portion, the center portion being limited to a region within 10% to 90% of the volume of the outermost layer, the center portion having present therein a compound of a metal from column VIII of the periodic table.

Also, the present invention provides a silver halide emulsion comprising tabular particles, the tabular particles occupying at least 50% of a total projected area of all particles, taking a {111} surface as a principal plane, and having an aspect ratio of at least 2.0, the tabular particles being disposed with an outermost layer containing at least 30 mol % of silver bromide, tabular particles having a silver chloride content of at least 95 mol % and a silver iodide content of 0.05 mol % to 0.75 mol %, wherein the outermost layer have a center portion, the center portion being limited to a region within 10% to 90% of the volume of the outermost layer, the center portion having present therein a compound of a metal from column VIII of the periodic table.

Further, the present invention provides a silver halide color photographic light-sensitive material comprising a support having disposed thereon at least a silver halide emulsion layer containing a yellow dye-forming coupler, a silver halide emulsion layer containing a magenta dye-forming coupler and a silver halide emulsion layer containing a cyan dye-forming coupler, wherein at least one of the silver halide emulsions comprises high silver chloride particles, the high silver chloride particles having a continuous outermost layer containing at least 30 mol % of silver bromide, the high silver chloride particles having a silver chloride content of at least 95 mol % and a silver iodide content of 0.05 mol % to 0.75 mol %, wherein the outermost layer has a center portion, the center portion being limited to a region within 10% to 90% of the volume of the outermost layer, the center portion having present therein a compound of a metal from column VIII of the periodic table.

Moreover, the present invention provides a silver halide color photographic light-sensitive material comprising a support having disposed thereon at least a silver halide emulsion layer containing a yellow dye-forming coupler, a silver halide emulsion layer containing a magenta dye-forming coupler and a silver halide emulsion layer containing a cyan dye-forming coupler, wherein at least one of the silver halide emulsions comprises tabular particles, the tabular particles occupying at least 50% of a total projected area of all particles, taking a {111} surface as a principal plane, and having an aspect ratio of at least 2.0, wherein the tubular particles are disposed with an outermost layer containing at least 30 mol % of silver bromide, the tabular particles having a silver chloride content of at least 95 mol % and a silver iodide content of 0.05 mol % to 0.75 mol %, the outermost layer having a center portion, the center portion being limited to a region within 10% to 90% of the volume of the outermost layer, the center portion having present therein a compound of a metal from column VIII of the periodic table.

In addition, the present invention provides an image forming method comprising scan-exposing a silver halide color photographic light-sensitive material and thereafter conducting color development processing, the silver halide color photographic light-sensitive material comprising a support having disposed thereon at least a silver halide emulsion layer containing a yellow dye-forming coupler, a silver halide emulsion layer containing a magenta dye-forming coupler and a silver halide emulsion layer containing a cyan dye-forming coupler, wherein at least one of the silver halide emulsions comprises high silver chloride particles, the high silver chloride particles having a continuous outermost layer containing at least 30 mol % of silver bromide, the high silver chloride particles having a silver chloride content of at least 95 mol % and a silver iodide content of 0.05 mol % to 0.75 mol %, wherein the outermost layer has a center portion, the center portion being limited to a region within 10% to 90% of the volume of the outermost layer, the center portion having present therein a compound of a metal from column VIII of the periodic table.

Further, the present invention provides an image forming method comprising scan-exposing a silver halide color photographic light-sensitive material and thereafter conducting color development processing, the silver halide color photographic light-sensitive material comprising a support having disposed thereon at least a silver halide emulsion layer containing a yellow dye-forming coupler, a silver halide emulsion layer containing a magenta dye-forming coupler and a silver halide emulsion layer containing a cyan dye-forming coupler, wherein at least one of the silver halide emulsions comprises tabular particles, the tabular particles occupying at least 50% of a total projected area of all particles, taking a {111} surface as a principal plane, and having an aspect ratio of at least 2.0, wherein the tabular particles are disposed with an outermost layer containing at least 30 mol % of silver bromide, the tabular particles having a silver chloride content of at least 95 mol % and a silver iodide content of 0.05 mol % to 0.75 mol %, the outermost layer having a center portion, the center portion being limited to a region within 10% to 90% of the volume of the outermost layer, the center portion having present therein a compound of a metal from column VIII of the periodic table.

DETAILED DESCRIPTION OF THE PREFERRED EMBODIMENTS

Figure 1:
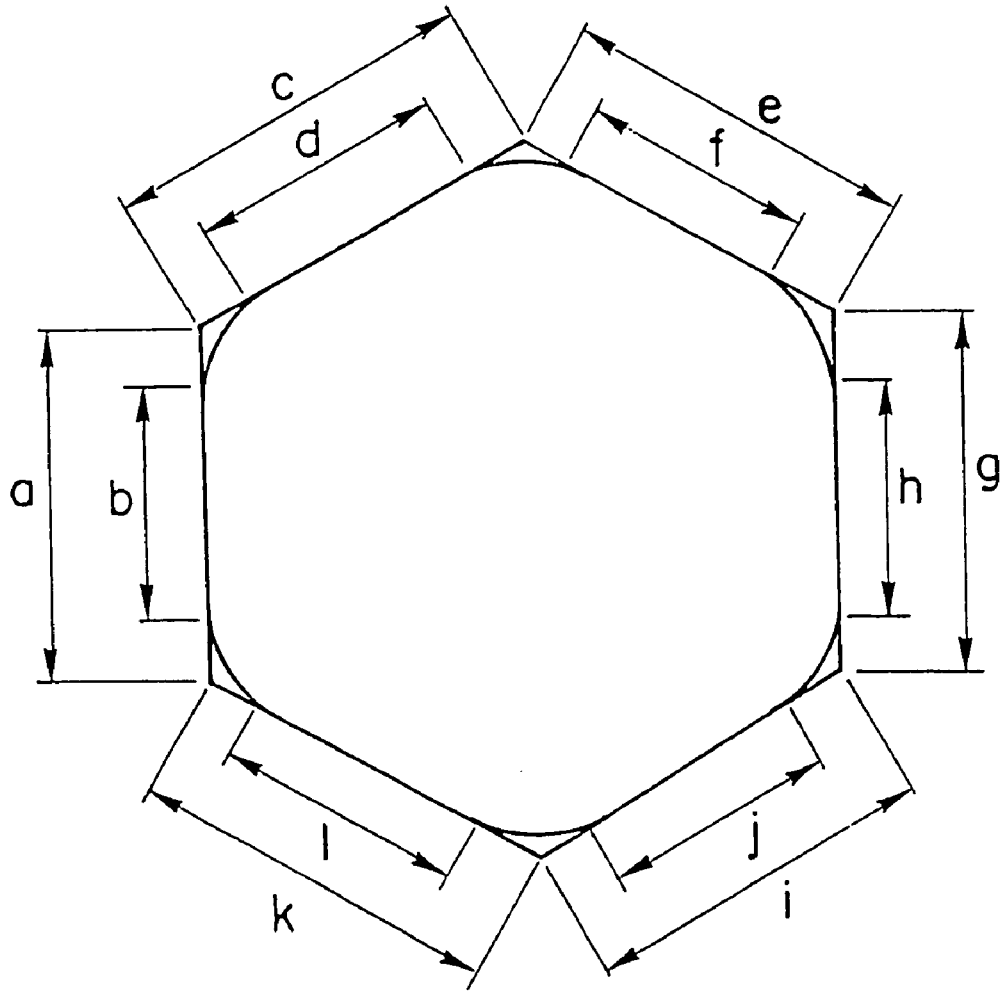
FIG. 1 is an explanatory view of a ratio of a straight line part of a silver halide particle.

The content of silver chloride of an emulsion of the present invention is 95 mol % or more, preferably 95 to 99.9 mol % and more preferably 98 to 99.9 mol %.

The content of silver bromide is preferably 0.01 to 5 mol %, more preferably 0.05 to 3 mol % and still more preferably 0.1 to 2 mol %.

The content of silver iodide is preferably 0.05 to 0.75 mol %, more preferably 0.1 to 0.6 mol % and still more preferably 0.2 to 0.5 mol %.

The shape of a particle of the silver halide emulsion of the present invention is not limited to a cubic, octahedron, tetradecahedron or tabular. It is particularly preferable that the particles be tabular particles in which particles corresponding to 50 to 100%, preferably 80 to 100%, more preferably 90 to 100% and still more preferably 95 to 100% of the total projected area of all silver halide particles have a {111} principal plane, a thickness of preferably 0.01 to 0.30 $\mu$m, more preferably 0.02 to 0.20 $\mu$m and still more preferably 0.05 to 0.15 $\mu$m, an aspect ratio of preferably 2.0 to 100, more preferably 2.0 to 50, still more preferably 4.0 to 50 and particularly preferably 6.0 to 50 and a projected diameter of preferably 0.1 to 10 $\mu$m, more preferably 0.2 to 5.0 $\mu$m and still more preferably 0.3 to 2 $\mu$m. The coefficient of variation in the projected diameter or the thickness (standard deviation of distribution/average projected diameter or average thickness) is preferably 0 to 0.4, more preferably 0 to 0.3 and still more preferably 0.01 to 0.2. Here, the aspect ratio is the value obtained by dividing the diameter of a circle equivalent to the projected area of a particle by the thickness of the particle. The larger the aspect ratio is, the thinner the thickness of the particle is and the flatter the particle is. In the present invention, the tabular particles are defined as those having an aspect ratio of 1.2 or more. The average aspect ratio means an average of the aspect ratios of all tabular particles in the emulsion. Also, the projected diameter means the diameter of a circle having the same area as the projected area of a particle and the thickness means the distance between two principal planes of a tabular particle. The projected diameter of a tabular particle means the diameter of a circle having the same area as the projected area obtained when the principal plane is laid in parallel to the substrate surface and viewed from the direction perpendicular thereto.

The particles having a more preferable shape are tabular particles in which the principal plane is hexagonal and preferably the ratio of the lengths of neighboring sides on the principal plane is 1 to 2.

The shape of the particle is preferably angular. The term "angular" means that the particle is neither rounded nor projected, specifically, the angle of the intersecting point to which the straight line parts of neighboring sides on the principal plane are extended substantially accords with the actual angle. Here, the term "substantially accord" means that the ratio of the straight line part is 0.8 or more, preferably 0.9 or more and more preferably 0.95 to 1.0.

The ratio of the straight line part, in the case of the hexagonal particle shown in FIG. 1, means the ratio between the sum of the lengths of the straight line parts of the sides of the hexagonal particle and the sum of the side lengths of the hexagon formed from intersecting points (six points) where the extended neighboring sides intersect each other when the straight line parts are extended (ratio of straight line part=(the sum of straight line parts of a tabular particle/the sum of the distances between intersecting points of extended lines)={(b+d+f+h+j+1)/(a+c+e+g+i+k)}). It is needless to say that in the case of a particle having no straight line part, the ratio of the straight line part is zero.

Also, in the present invention, when the straight line parts are extended and the intersecting point where the extended neighboring lines intersect each other is present inside of the particle, the particle is regarded as a rounded particle even if it has sharp corners. For instance, complex particles in which epitaxial growth is seen at the corners and particles having projections are regarded as rounded particles.

The silver halide emulsion of the present invention has a tabular particle having a sphere equivalent diameter of preferably 0.7 $\mu$m or less and more preferably 0.1 to 0.5 $\mu$m. The sphere equivalent diameter means the diameter of a sphere having the same volume as a particle.

A process of preparing the silver halide emulsion in the present invention, as is well-known, involves a step of forming a silver halide particle by a reaction of a water-soluble silver salt with a water-soluble halide, a desalting step and a chemical sensitization step.

In the present invention, the outermost layer is a continuous layer of silver halide (a layer in which the inside layer are perfectly enclosed by a layer of a halogen composition differing from the halogen composition of the inside layer) in a silver halide particle consisting of two or more layers (preferably 2 to 5 layers, more preferably 3 to 4 layers and most preferably 3 layers) differing from each other in halogen composition. The content of silver bromide in the outermost layer is 30 mol % or more (preferably 30 to 100 mol %), more preferably 40 mol % or more and 90 mol % or less and still more preferably 50 mol % or more and 80 mol % or less. The content of silver bromide in the outermost layer can be examined using an X-ray photoelectron spectrometer (ESCA, XPS). The content can be measured with high accuracy by putting a sample to be measured in a low temperature condition.

The volume of the outermost layer is 10% or less (preferably 0.1 to 10%), more preferably 5% or less and 0.2% or more and still more preferably 2% or less and 0.5% or more of the total volume of the particle.

The outermost layer ensures that the particle is not rounded and the shape stability of the particle is outstandingly improved.

The outermost layer in the present invention is obtained by adding an aqueous silver nitrate solution and an aqueous solution of a bromide salt (e.g., potassium bromide or sodium bromide) to a tabular particle-containing solution after a tabular particle or preferably a {111} tabular particle is formed. At this time, it is important that the temperature of the reaction system to which these solutions are added is 40° C. or more (preferably 40 to 90° C.) and that the temperature is controlled at a fixed temperature, preferably 50 to 85° C. and more preferably 65° C. to 80° C. Moreover, the silver potential in the reaction system is 100 mV or less (preferably 40 to 100 mV) and more preferably 80 mV to 40 mV.

In the present invention, it is necessary to make a VIII metal of the periodic table exist in the outermost layer. The position where the metal exists is limited to the center of the outermost layer in the direction of thickness and to a range of 10% to 90%, preferably 20% to 80% and more preferably 40% to 60% of the volume of the outermost layer. Namely, it is required that the metal compound is not present in the surface of the particle and at the interface of a base particle.

In the present invention, in order to provide within the central portion of the outermost layer the compound of a metal from column VIII of the periodic table, a solution containing the compound may be added during the time the outermost layer is formed, subsequent to initiation of addition of the silver nitrate solution and prior to the time at which addition of the silver nitrate solution is completed. Specifically, the VIII metal compound solution is added at any point during the time in which the silver nitrate solution is being added, except for two time zones at the beginning and end of the silver nitrate solution addition. The time zones are each preferably 10% of the total time required for addition of the silver nitrate solution, more preferably 20%, and most preferably 30%.

Various polyvalent metal ion impurities may be introduced into the silver halide emulsion used in the present invention in processes for forming an emulsion particle or for performing physical ripening. Given as examples of compounds which may be used together are salts or complex salts of VIII metals of the periodic table such as iron, iridium, ruthenium, osmium, rhenium, rhodium, cadmium, zinc, lead, copper and thallium. In the present invention, compounds of metals such as iron, ruthenium, osmium and rhenium which have at least four cyan ligands are particularly preferable with the view of improving high illuminance sensitivity and suppressing the sensitization of a latent image. Also, iridium compounds produce an enormous effect on the provision of adaptability to exposure at high illuminance. The amount of these compounds is selected according to the purpose and is preferably $10^{-9}$ to $10^{-2}$ mol based on 1 mol of the silver halide. These metal ions will be explained in more detail. These metal ions are, however, not intended to be limiting of the present invention.

Iridium ion-containing compounds are trivalent or tetravalent salts or complex slats. Among these compounds, complex salts are preferable. For example, halogens, amines and oxalato complex salts such as iridium (III) chloride, iridium (III) bromide, iridium (IV) chloride, sodium hexachloroiridate (III), potassium hexachloroiridate (IV), hexaammine iridium (IV) salt, trioxalatoiridium (III) salt and trioxalatoiridium (IV) salt are preferable. Among these compounds, iridium compounds having an organic ligand are desirable.

Preferable examples of iridium ion-containing compounds include the following compounds.

$K_3[IrCl_6]$
$K_2[IrCl_6]$
$K_3[IrBr_6]$
$K_2[IrBr_6]$
$K_2[IrCl_5(CH_2O)]$
$K_2[IrFCl_5]$
cis-$K_2[IrF_2Cl_4]$
trans-$K_2[IrF_2Cl_4]$
mer-$K_2[IrF_3Cl_3]$
fac-$K_2[IrF_3Cl_3]$
cis-$K_2[IrF_4Cl_2]$
trans-$K_2[IrF_4Cl_2]$
$K_2[IrF_5Cl]$
$K_2[IrF_6]$
$K_2[Ir(CN)_6]$
$K_2[Ir(CN)_5Cl]$
$K_2[Ir(CN)_4I_2]$
$K[IrCl_4(en)]$ (en = ethylenediamine)
$K[IrBr_4(en)]$
$K_2[IrCl_5(CH_3CN)]$
$K[IrCl_4(CH_3CN)_2]$
$K_2[IrCl_5(thia)]$ (thia = thiazole)
$K_2[IrCl_5(pyz)]$ (pyz = pyrazine)
$K[IrCl_4(pyz)_2]$
$[IrCl_3(pyz)_3]$
$K_2[IrCl_5(pym)]$ (pym = pyrimidine)
$K_3[IrCl_4(C_2O_4)]$

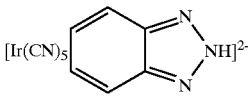

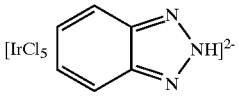

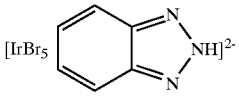

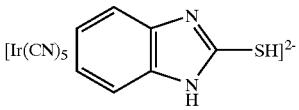

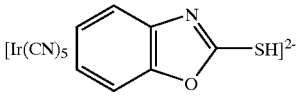

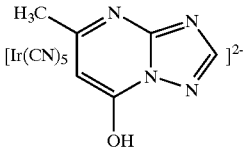

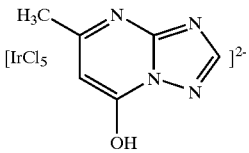

-continued

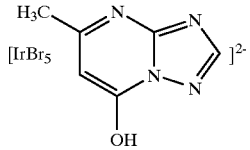

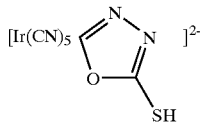

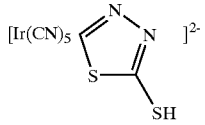

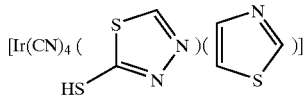

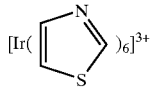

$K_2[IrCl_3(py)(C_2O_4)]$ (py = pyridine)
$[N(CH_3)_4]\ [IrCl_4(CH_3SCH_2CH_2SCH_3)]$
$[Ir(bpy)_3]Cl_3$ (bpy = 2,2'-bipyridine)
$[IrCl_2(bpy)_2]Cl$
$[Ir(bpy)_2(H_2O)\ (4,4'\text{-bpy})]Cl_3$ (4,4'-bpy = 4,4'-bipyridine)
$[Ir(bpy)_2(OH)\ (4,4'\text{-bpy})]Cl_2$
$[IrHCO(P(Ph)_3)_3]^{2+}$ (Ph = $C_6H_5$)
$[IrH_3(P(Ph)_3)_2]^{2+}$

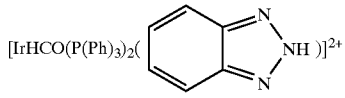

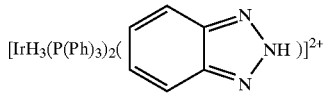

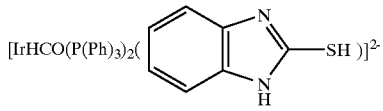

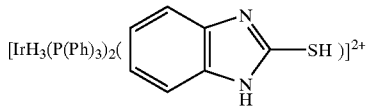

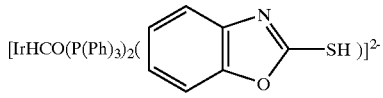

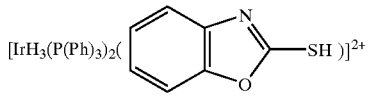

-continued

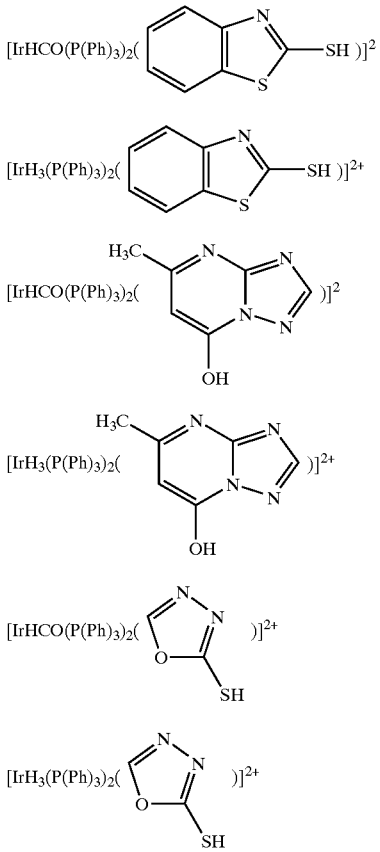

Platinum ion-containing compounds are divalent or tetravalent salts or complex salts and complex salts are preferable. For example, platinum (IV) chloride, potassium hexachloroplatinate, tetrachloroplatinic (II) acid, tetrabromoplatinic (II) acid, sodium tetraxis (thiocyanato)platinate (IV) or hexaammineplatinum (IV) chloride is used.

Palladium ion-containing compounds are generally divalent or tetravalent salts or complex salts. Particularly, complex salts are preferable. For example, sodium tetrachloropalladate (II), sodium tetrachloropalladate (IV), potassium hexachloropalladate (IV), tetraamminepalladium (II) chloride or potassium tetracyanopalladate (II) is used. As nickel ion-containing compounds, nickel chloride, nickel bromide, potassium tetrachloroniccolate (II), hexaamminenickel (II) chloride or sodium tetracyanoniccolate (II) is used.

Rhodium ion-containing compounds are preferably trivalent salts or complex salts in general. For example, potassium hexachlororhodate, sodium hexabromorhodate or ammonium hexachlororhodate is used. Iron ion-containing compounds are divalent or trivalent compounds containing an iron ion and preferably iron salts or iron complex salts which are water-soluble in the range of the concentration to be used. Iron complex salts which are easily contained in the silver halide particle are particularly preferable. Examples of these iron complex salts include ferrous chloride, ferric chloride, ferrous hydroxide, ferric hydroxide, ferrous thiocyanate, ferric thiocyanate, hexacyano iron (II) complex salts, hexacyano iron (III) complex salts, ferrous thiocyanate complex salts and ferric thiocyanate complex salts. Six-coordination metal complexes having at least four cyan ligands as described in European Patent EP No. 0,336,426A are also preferably used.

The silver halide particle of the present invention can contain the aforementioned metal ion-donating compound by a means of dispersing the compound in an aqueous gelatin solution, aqueous halide solution or aqueous silver salt solution which is used for the formation of the silver halide particle, by a means of adding a dispersion prepared by dispersing the compound in other aqueous solution or a solution prepared by dissolving the compound in a solvent to a reaction system or by adding a silver halide fine particle which contains the metal ion in advance to dissolve this fine particle.

In the present invention, as the metal compound to be incorporated into the outermost layer, iridium compounds are desirable and iridium compounds having an organic ligand are more desirable.

In the present invention, the content of silver iodide is 0.05 mol % to 0.75 mol %, which is the proportion of silver iodide as a whole in the particle. The proportion of silver iodide in a part where silver iodide is localized is preferably 0.5 mol % to 5 mol % and more preferably 1 mol % to 4 mol %. A layer in which silver iodide is localized is preferably adjacent to the outermost layer. Namely, a layer positioned at the side inner than the outermost layer by one layer is the silver iodide-localized layer and it is undesirable that silver iodide exist in the particle except for the silver iodide-localized layer. Also, it is undesirable that silver bromide exist in the particle except for the outermost layer.

The silver halide emulsion used in the present invention is chemically sensitized. As to the method of chemical sensitization, sulfur sensitization represented by the addition of an unstable sulfur compound, precious metal sensitization such as gold sensitization, reducing sensitization and the like may be used either singly or in combinations. As compounds used for chemical sensitization, compounds described in JP-A No. 62-215272, page 18, right lower column to page 22, right upper column are preferably used.

The silver halide emulsion used in the present invention is preferably one subjected to gold sensitization well-known in the fields concerned. This is because the provision of gold sensitization more decreases a variation in photographic qualities when scan-exposure is performed using laser light or the like. When gold sensitization is carried out, compounds such as chloroauric acid or its salts, gold thiocyanates or gold thiosulfates may be used. The amount of each of these compounds to be added can be widely changed corresponding to the cases; it is however $5\times10^{-7}$ to $5\times10^{3}$ mol and preferably $1\times10^{-6}$ to $1\times10^{-4}$ mol based on 1 mol of silver halide.

In the present invention, the gold sensitization may be combined with other sensitizing methods such as sulfur sensitization, selenium sensitization, tellurium sensitization, reducing sensitization and precious metal sensitization using a precious metal other than gold compounds.

The emulsion of the present invention preferably contains a thiosulfonic acid compound and sulfinic acid compound. Particularly, it is preferable to contain a thiosulfonic acid compound and a sulfinic acid compound represented by the formulae (X) and (Y) respectively.

$$R^{21}—SO_2S-M^{21} \qquad \text{Formula (X)}$$

$$R^{22}—SO_2-M^{22} \qquad \text{Formula (Y)}$$

wherein $R^{21}$ and $R^{22}$ respectively represent an aliphatic group, an aromatic group or a heterocyclic group, $M^{21}$ and $M^{22}$ respectively represent a positive ion. Aliphatic groups represented by $R^{21}$ or $R^{22}$ in the formulae (X) and (Y)

include linear, branched or cyclic alkyl groups, alkenyl groups and alkynyl groups wherein there is no particular limitation to the number of carbon atoms; however, the number of carbon atoms is preferably the order required to dissolve the compound in water; organic solvents including lower alcohol such as methanol or ethanol and ethyl acetate or mixed solvents of these solvents.

The aromatic groups represented by $R^{21}$ and $R^{22}$ include a phenyl group and naphthyl group. As the heterocyclic group, five to seven-membered rings containing at least one of a nitrogen atom, oxygen atom and sulfur atom as a hetero atom are preferable. This ring may be either saturated or unsaturated. Also, those obtained by condensing other rings such as a benzene ring and a hetero ring are acceptable.

These aliphatic groups, aromatic groups and heterocyclic groups may have a substituent. As the substituent, although no particular limitation is imposed on the number and type of substituents, those which promote or, at least, do not disturb dissolution in water, organic solvents or mixed solvents of these solvents are preferable.

Specific examples of the substituent include an alkoxy group, aryl group, alkyl group, halogen atom, amino group, carboxyl group, hydroxyl group and heterocyclic group.

Examples of the positive ion represented by $M^{21}$ and $M^{22}$ include alkali metals (e.g., $Li^+$, $Na^+$ and $K^+$) and ammonium ions ($NH_4^+$ and tetraethylammonium ions).

Specific typical examples of the thiosulfonic acid compounds and sulfinic acid compounds are given below.

(X-1) $CH_3SO_2SNa$ (X-2) $C_2H_5SO_2SNa$ (X-3) $C_2H_5SO_2SK$ (X-4) $C_4H_9SO_2SLi$ (X-5) $C_6H_{13}SO_2SNa$ (X-6) $C_8H_{17}SO_2SNa$ (X-7) $CH_3(CH_2)_3CH(C_2H_5)CH_2SO_2S{\bullet}NH_4$ (X-8) $C_{10}H_{21}SO_2SNa$ (X-9) $C_{12}H_{25}SO_2SNa$ (X-10) $C_{16}H_{33}SO_2SNa$ (X-11) $(CH_3)_2CHSO_2SK$ (X-12) $t\text{-}C_4H_9SO_2SNa$ (X-13) $CH_3OCH_2CH_2SO_2S{\bullet}Na$ (X-14)

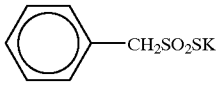

(X-15) $CH_2{=}CHCH_2SO_2SNa$ (X-16)

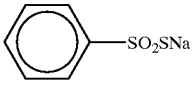

-continued (X-17)

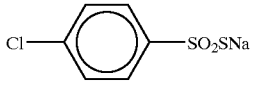

(X-18)

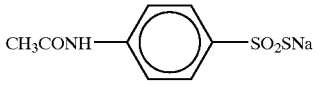

(X-19)

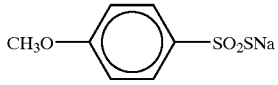

(X-20)

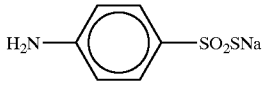

(X-21)

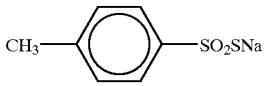

(X-22)

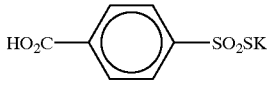

(X-23)

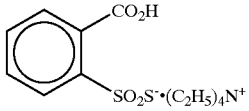

(X-24)

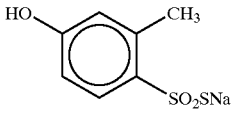

(X-25)

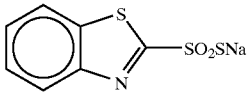

(X-26)

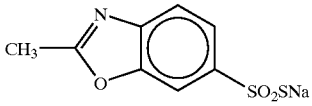

(X-27)

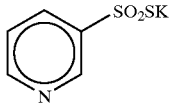

(X-28)

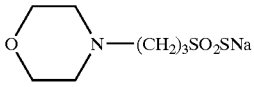

The amount of the thiosulfonic acid compound is $1\times10^{-6}$ to $5\times10^{-3}$ mol and preferably $3\times10^{-6}$ to $5\times10^{-4}$ mol based on 1 mol of silver halide.

(Y-1) $CH_3SO_2{\bullet}Na$ (Y-2) $C_2H_5SO_2{\bullet}Na$ (Y-3) $C_2H_5SO_2{\bullet}K$ (Y-4) $C_4H_9SO_2{\bullet}Li$ (Y-5) $C_6H_{13}SO_2{\bullet}Na$ -continued (Y-6) $C_8H_{17}SO_2{\bullet}Na$ (Y-7) $CH_3(CH_2)_3CH(C_2H_5)CH_2SO_2{\bullet}NH_4$ (Y-8) $C_{10}H_{21}SO_2{\bullet}Na$ (Y-9) $C_{12}H_{25}SO_2{\bullet}Na$ (Y-10) $C_{16}H_{33}SO_2{\bullet}Na$ (Y-11) $(CH_3)_2CHSO_2{\bullet}K$ (Y-12) $t\text{-}C_4H_9SO_2{\bullet}Na$ (Y-13) $CH_3OCH_2CH_2SO_2{\bullet}Na$ (Y-14) 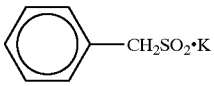

(Y-15) $CH_2{=}CHCH_2SO_2{\bullet}Na$ (Y-16) 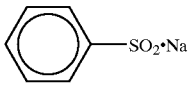

(Y-17) 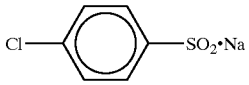

(Y-18) 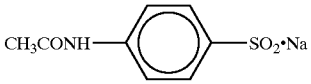

(Y-19) 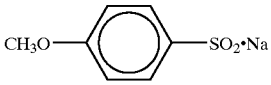

(Y-20) 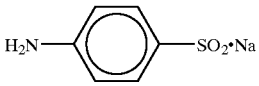

(Y-21) 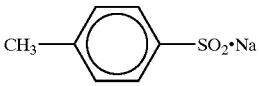

(Y-22) 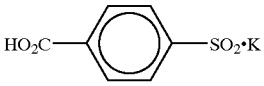

(Y-23) 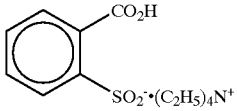

(Y-24) 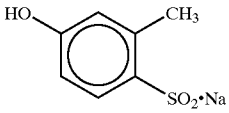

(Y-25) 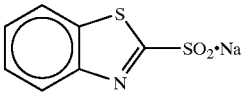

-continued (Y-26) 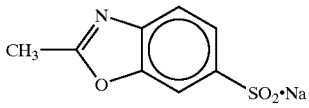

(Y-27) 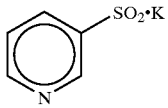

(Y-28) 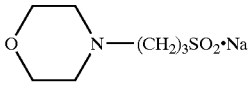

The amount of the sulfinic acid compound is $1\times10^{-6}$ to $1\times10^{-3}$ mol and preferably $3\times10^{-6}$ to $4\times10^{-4}$ mol based on 1 mol of silver halide.

It is preferable that a mixture in which respective amounts of the thiosulfonic acid compound and the sufinic compound to be added are pre-mixed, and that this mixture is added to the system. Although there are no particular limitations as to the step in which the mixed solution is added, it is preferable that the mixed solution is added during the formation of the particles and during the chemical sensitization step. It is more preferable to add the mixed solution by the time the formation of the particle is completed by 50% and in the initial stage of chemical sensitization.

Various compounds may be added to the silver halide emulsion used in the present invention for the purpose of preventing fogging during the production step, storing and photographic treatment of the emulsion or the light-sensitive material or for the purpose of stabilizing photographic qualities. Specifically, many compounds known as antifoggants or stabilizersmaybe added. Examples of these compounds include azoles such as benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, mercaptotetrazoles (particularly, 1-phenyl-5-mercaptotetrazole and the like); mercaptopyrimidines and mercaptotriazines; thioketo compounds such as oxazolinethione; azaindenes such as triazaindenes, tetraazaindenes (particularly, 4-hydroxy substituted (1,3,3a,7)tetraazaindene) and pentaazaindenes; benzenethiosulfonic acid, benzenesulfinic acid and benzenesulfonic acid amide. Particularly preferable compounds are mercaptotetrazoles. These mercaptotetrazoles have the abilities to more improve high illuminance sensitivity besides the abilities to prevent fogging and to improve stability and are therefore preferable.

In the silver halide color photographic light-sensitive material of the present invention, a gelatin is used as a hydrophilic binder. As required, hydrophilic colloids including other gelatin derivatives, graft polymers of a gelatin and other polymers, proteins other than a gelatin, sugar derivatives, cellulose rivatives, synthetic hydrophilic polymer materials such as homopolymers or copolymers may be used.

The gelatin used in the silver halide color photographic light-sensitive material of the present invention may be either gelatins treated with lime or gelatins treated with an acid. Also, the gelatin may be gelatins produced using, as starting material, any one of cattle bones, cattle skins and swine skins and is preferably gelatins treated with lime and produced using cattle bones or swine skins as starting material are preferable.

In the present invention, the total amount of the hydrophilic binder contained in light-sensitive silver halide emulsion layers and light-insensitive hydrophilic colloidal layers arranged between the support and the hydrophilic colloidal layer most apart from the support present on the side on which the silver halide emulsion layer is formed is 6.5 $g/m^2$ or less and most preferably 5.5 $g/m^2$ or less and 4.0 $g/m^2$ or more in view of rapid treatment. If the amount of the hydrophilic binder is small, this is effective to accelerate, particularly, color developing and a water-washing step.

In the present invention, the ratio of "amount of a hydrophilic binder/thickness of a silver halide emulsion" in all silver halide emulsion layers is preferably 1.5 or more. This ratio is hereinafter called "B/AgX" ratio in the present invention.

Here, the amount of the hydrophilic binder means the amount ($g/m^2$) of the hydrophilic binder per 1 $m^2$ of the silver halide emulsion layer. It is understood that the value obtained by dividing the amount of the hydrophilic binder by its specific gravity shows the thickness and the amount of the binder in the present invention is proportional to the thickness.

On the other hand, the thickness of the silver halide emulsion means the thickness ($\mu$m) occupied by the silver halide emulsion particles distributed in a direction perpendicular to the support in the silver halide emulsion layer. In the present invention, the side length ($\mu$m) of a cubic in the case of a cubic particle or the thickness in a direction perpendicular to the principal plane in the case of a tabular particle is designated as the thickness ($\mu$m) of the silver halide emulsion on the premise that the silver halide emulsion layer is applied ideally. Also, in the case where silver halide emulsion particles having different sizes are mingled and used together, an average of the masses of each particle is designated as the thickness of the silver halide emulsion.

As is clear from its definition, it is understood that if the "B/AgX" ratio in the present invention is increased, the thickness of the emulsion in the emulsion layer becomes relatively small. In the present invention, the "B/AgX" ratio is 1.50 or more, preferably 1.70 or more, more preferably 1.90 or more and most preferably 6.0 or more with the view of restricting the increase of stripe-like density caused by pressure and reducing color mixing.

In the present invention, the silver halide emulsion layer containing a yellow coupler may be disposed on any position on the support without any problem; however, it is preferably formed on a position more apart from the support than at least one of the magenta coupler-containing silver halide emulsion layer and the cyan coupler-containing silver halide emulsion layer. Also, the yellow coupler-containing emulsion layer is preferably formed on a position most apart from the support in contrast to other silver halide emulsion layers in view of the promotion of color developing and desilverization and a reduction of residual color caused by sensitizing dyes. Moreover, the cyan coupler-containing silver halide emulsion layer is preferably positioned in the center between other silver halide emulsion layers in view of the reduction of Blix fading and is preferably formed as the lowermost layer in view of the reduction of photo-fading. Also, each of yellow, magenta and cyan color developing layers may be composed of two or three layers. For example, a coupler layer containing no silver halide emulsion is preferably formed close to a silver halide emulsion layer and used as a color developing layer as described in JP-A No. 4-75055, JP-A No. 9-114035, JP-A No. 10-246940 and U.S. Pat. No. 5,576,159.

The yellow coupler-containing silver halide emulsion layer is preferably formed most apart from the support in contrast to other magenta or cyan coupler-containing silver halide layer. In the yellow coupler-containing silver halide emulsion layer, the amount of the hydrophilic binder is preferably 1.35 $g/m^2$ or less, more preferably 1.25 $g/m^2$ or less and most preferably 1.20 $g/m^2$ or less and 0.60 $g/m^2$ or more. Also, the side length when a cubic particle is used in the silver halide emulsion is preferably 0.80 $\mu$m or less, more preferably 0.75 $\mu$m or less and most preferably 0.70 $\mu$m or less and 0.30 $\mu$m or more. The side length when a tabular particle is used is preferably 0.40 $\mu$m or less and 0.02 $\mu$m or more, more preferably 0.30 $\mu$m or less, still more preferably 0.20 $\mu$m or less and most preferably 0.15 $\mu$m or less and 0.05 $\mu$m or more. The aspect ratio of the tabular particle is preferably 2 to 10 and more preferably 3 to 8. Also, as the silver halide emulsion, silver halide particles differing in size and shape are preferably mixed for use to control sensitivity, gradation and other photographic qualities.

In the present invention, the amount of the silver halide emulsion to be applied is 0.60 $g/m^2$ or less and 0.10 $g/m^2$ or more, more preferably 0.55 $g/m^2$ or less and 0.20 $g/m^2$ or more and most preferably 0.50 $g/m^2$ or less and 0.25 $g/m^2$ or more.

When a cubic silver halide emulsion particle is used for the cyan color developing layer and the magenta color developing layer, the side length of the particle is preferably 0.50 $\mu$m or less and more preferably 0.40 $\mu$m or less and 0.10 $\mu$m or more.

In the present invention, the film thickness of the photographic structural layers shows the thickness of a photographic structural layers disposed on the upper side with respect to the support before the photographic structural layers are treated. Concretely, the thickness can be found by any one of the following methods. First, the silver halide color photographic light-sensitive material is cut in a direction perpendicular to the support and the section is observed using a microscope to thereby find the thickness. As a second method, there is a method in which the film thickness is calculated from the coating amount ($g/m^2$) and specific gravity of each component contained in the photographic structural layer.

For instance, the specific gravities of a gelatin and silver chloride which are typically used for photographs are 1.34 $g/cm^3$ and 5.59 $g/cm^3$ respectively. The specific gravities of other lipophilic additives are measured prior to the formation of the layer whereby the film thickness can be calculated using the second method.

In the present invention, the film thickness of each of the photographic structural layers is 9.0 $\mu$m or less, more preferably 8.0 $\mu$m or less and most preferably 7.0 $\mu$m or less and 3.5 $\mu$m or more.

In the present invention, the hydrophobic photographic material implies an oil-soluble component excluding the dye-forming couplers. The oil-soluble component is a lipophilic component remaining in the light-sensitive material after processed. Specific examples of the lipophilic components include dye-forming couplers, high-boiling point organic solvents, color mixing preventives, ultraviolet absorbers, lipophilic additives, lipophilic polymers or polymer latex, matting agents and slipping agents, which are generally added to the photographic structural layer as lipophilic fine particles. Therefore, the water-soluble dyes, film hardeners, water-soluble additives and silver halide emulsions do not fall under a category of the oil-soluble component. In addition, although a surfactant is usually used when the lipophilic fine particles are prepared, the surfactant is not handled as the oil-soluble component in the present invention.

The total amount of the oil-soluble component is preferably 4.5 g/m$^2$ or less, more preferably 4.0 g/m$^2$ or less and most preferably 3.8 g/m$^2$ or less and 3.0 g/m$^2$ or more. In the present invention, the value obtained by dividing the mass (g/m$^2$) of the hydrophobic photographic material contained in the dye-forming coupler-containing layer by the mass (g/m$^2$) of the dye-forming coupler is preferably 4.5 or less, more preferably 3.5 or less and most preferably 3.0 or less.

In the present invention, the ratio of the oil-soluble component to the hydrophilic binder in the photographic structural layer may be arbitrarily set. The ratio in the photographic structural layer except for the protective layer is preferably 0.05 to 1.50, more preferably 0.10 to 1.40 and most preferably 0.20 to 1.30. The ratio in each layer is optimized, making it possible to control film strength, wear resistance and curling characteristics.

In the color photographic light-sensitive material of the present invention, the silver halide emulsion produced by the production method of the present invention is contained in at least one layer among the silver halide emulsion layers. As other silver halide to be used for the color light-sensitive material of the present invention, silver chloride, silver bromide, silver (iodo)chlorobromide and silver bromoiodide may be used. The use of a high silver chloride emulsion in which the content of silver chloride is 90 mol % or more, further 95 mol % or more and particularly 98 mol % or more is desirable for the purpose of attaining rapid treatment. Moreover, the existence of a silver bromide-localized phase is preferred. Also, the use of a tabular particle having a {100} plane or a {111} plane as its principal plane makes it possible to increase the "B/AgX" ratio, which is desirable in view of the speed-up of color developing and a reduction in process color mixing.

In the light-sensitive material of the present invention, a dye (especially, an oxonol type dye) which can be decolored by treatment as described in European Patent EP No. 0,337,490A2, pp27–76 is preferably added to the hydrophilic colloidal layer such that the optical reflecting density of the light-sensitive material at 680 nm is increased to 0.70 or more for the purpose of improving the sharpness of an image. Also, titanium oxide which is surface-treated using divalent to tetravalent alcohols (e.g., trimethylolethane) is preferably contained in the water-resistant resin layer of the support in an amount of 12% by weight or more (more preferably 14% by weight or more).

Other conventionally known photographic materials and additives may be used in the silver halide photographic light-sensitive material of the present invention.

For example, as the photographic support, a transmission type support or a reflective type support may be used. As the transmission type support, those prepared by forming an information-recording layer such as a magnetic layer on a transmissible film such as a cellulose nitrate film and polyethylene terephthalate film and further, a polyester produced from 2,6-naphthalenedicarboxylic acid (NDCA) and ethylene glycol (EG) or a polyester produced from NDCA, terephthalic acid and EG are preferably used. As the reflective type support, particularly a reflective support provided with plural polyethylene layers and polyester layers laminated thereon and containing a white pigment such as titanium oxide in at least one of such water-resistant resin layers (laminated layers) is preferable.

Given as more preferable examples of the reflective support are reflective supports provided with a polyolefin layer having fine voids on a paper base on the side on which the silver halide emulsion layer is formed. The polyolefin layer may be composed of a multilayer. In this case, it is more preferable that the polyolefin (e.g., polypropylene and polyethylene) layer adjacent to the gelatin layer on the side of the silver halide emulsion layer have no fine void and the polyolefin (e.g., polypropylene and polyethylene) layer on the side close to the paper base have fine voids. The density of the polyolefin layer composed of a multilayer or a single layer which is positioned between the paper base and the photographic structural layers is preferably 0.40 to 1.0 g/cm$^3$ and more preferably 0.50 to 0.70 g/cm$^3$. The thickness of the polyolefin layer composed of a multilayer or a single layer which is positioned between the paper base and the photographic structural layers is preferably 10 to 100 $\mu$m and more preferably 15 to 70 $\mu$m. The ratio of the thickness of the polyolefin layer to that of the paper base is preferably 0.05 to 0.2 and more preferably 0.1 to 0.15.

It is also preferable to dispose a polyolefin layer on the above paper base on the reverse side (backface) with respect to the photographic structural layers with the view of improving the rigidity of the reflective support. In this case, materials used for the polyolefin layer on the backface is preferably a polyethylene or a polypropylene whose surface is matted and a matted polypropylene is more preferable. The thickness of the polyolefin layer on the backface is preferably 5 to 50 $\mu$m and more preferably 10 to 30 $\mu$m. Further, the density is preferably 0.7 to 1.1 g/cm$^3$. In the reflective support, as preferable embodiments as to the polyolefin layer formed on the paper base, examples described in JP-A No. 10-333277, JP-A No. 10-333278, JP-A No. 11-52513, JP-A No. 11-65024, EP No. 0880065 and EP No. 0880066 are given.

Moreover, a fluorescent whitening agent is preferably contained in the aforementioned water-resistant resin. Also, the fluorescent whitening agent may be dispersed in the hydrophilic colloidal layer of the light-sensitive material. As the fluorescent whitening agent, a benzoxazol type, cumarin type or pyrazoline type may be preferably used and a benzoxazolylnaphthalene type and benzoxazolylstilbene type fluorescent whitening agents are more prefrable. The amount to be used is, though not particularly limited to, preferably 1 to 100 mg/m$^2$. The mixing ratio when the fluorescent whitening agent is mixed with the water-resistant resin is preferably 0.0005 to 3% by weight and more preferably 0.001 to 0.5% by weight based on the resin.

As the reflective support, those prepared by forming a hydrophilic colloidal layer containing a white pigment on a transmission type support or a reflective support as mentioned above may be used.

Also, the reflective support may be a support having a metal surface having mirror reflectivity or diffuse reflectivity of the second kind.

With regard to the aforementioned reflective type support, silver halide emulsion, types of different metal ion introduced into the silver halide particle by doping, the storage stabilizers or antifoggants for the silver halide emulsion, chemical sensitization method (sensitizer), spectral sensitization method (spectral sensitizer), cyan, magenta and yellow couplers and method of the emulsion-dispersion thereof, color image-preserving ability improvers (anti-stain agents and fading preventives), dyes (coloring layers), types of gelation, the layer structure of the light-sensitive material and the pH of a film of the light-sensitive material, those described in the Patents listed in Tables 1 and 2 may be preferably used in the present invention.

TABLE 1

| Element | JP-A No. 7-104448 | JP-A No. 7-77775 | JP-A No. 7-301895 |
|---|---|---|---|
| Reflective type support | Column 7, line 12 to column 12, line 19 | Column 35, line 43 to column 44, line 1 | Column 5, line 40 to column 9, line 26 |
| Silver halide emulsion | Column 72, line 29 to column 74, line 18 | Column 44, line 36 to column 46, line 29 | Column 77, line 48 to column 80, line 28 |
| Types of different metal ion | Column 74, line 19 to line 44 | Column 46, line 30 to column 47, line 5 | Column 80, line 29 to column 81, line 6 |
| Storage stabilizer or antifoggant | Column 75, line 9 to line 18 | Column 47, line 20 to line 29 | Column 18, line 11 to column 31, line 37 (particularly, mercaptohetero-cyclic compound) |
| Chemical sensitization method (chemical sensitizer) | Column 74, line 45 to column 75, line 6 | Column 47, line 7 to line 17 | Column 81, line 9 to line 17 |
| Spectral sensitization method (spectral sensitizer) | Column 75, line 19 to column 76, line 45 | Column 47, line 30 to column 49, line 6 | Column 81, line 21 to column 82, line 48 |
| Cyan coupler | Column 12, line 20 to column 39, line 49 | Column 62, line 50 to column 63, line 16 | Column 88, line 49 to column 89, line 16 |
| Yellow coupler | Column 87, line 40 to column 88, line 3 | Column 63, line 17 to line 30 | Column 89, line 17 to line 30 |
| Magenta coupler | Column 88, line 4 to line 18 | Column 63, line 3 to column 64, line 11 | Column 31, line 34 to column 77, line 44 and column 88, line 32 to line 46 |
| Method of emulsion-dispersion of a coupler | Column 71, line 3 to column 72, line 11 | Column 61, line 36 to line 49 | Column 87, line 35 to line 48 |
| Color image-preserving ability improver (anti-staining agent) | Column 39, line 50 to column 70, line 9 | Column 61, line 50 to column 62, line 49 | Column 87, line 49 to column 88, line 48 |
| Fading preventive | Column 70, line 10 to column 71, line 2 | | |
| Dye (coloring agent) | Column 77, line 42 to column 78, line 41 | Column 7, line 14 to column 19, line 42 and column 50, line 3 to column 51, line 14 | Column 9, line 27 to column 18, line 10 |
| Type of gelatin | Column 78, line 42 to line 48 | Column 51, line 15 to line 20 | Column 83, line 13 to line 19 |
| Layer structure of a light-sensitive material | Column 39, line 11 to line 26 | Column 44, line 2 to line 35 | Column 31, line 38 to column 32, line 33 |
| pH of a film of a light-sensitive material | Column 72, line 12 to line 28 | | |
| Scan-exposure | Column 76, line 6 to column 77, line 41 | Column 49, line 7 to column 50, line 2 | Column 82, line 49 to column 83, line 12 |
| Preservative in a developing solution | Column 88, line 19 to column 89, line 22 | | |

As the cyan, magenta and yellow couplers to be used together in the present invention, besides the above couplers, couplers described in JP-A No. 62-215272, page 91, right upper column, line 4 to page 121, left upper column, line 6, JP-A No. 2-33144, page 3, right upper column, line 14 to page 18, left upper column, bottom line and page 30, right upper column, line 6 to page 35, right lower column, line 11, European Patent No. 355,660A2, page 4, line 15 to line 27, page 5, line 30 to page 28, bottom line, page 45, line 29 to line 31 and page 47, line 23 to page 63, line 50, JP-A No. 8-122984 and JP-A No. 9-222704 are also useful.

As the cyan coupler which may be used in the present invention, apyrrolotriazole type coupler is preferably used. Couplers represented by the formula (I) or (II) in JP-A No. 5-313324, couplers represented by the formula (I) in JP-A No. 6-347960 and exemplified couplers described in these patents are particularly preferable.

Also, phenol type or naphthol type cyan couplers are preferable and, for example, cyan couplers represented by the formula (ADF) as described in JP-A No. 10-333297 are preferable.

As cyan couplers other than above, pyrroloazole type cyan couplers as described in the specifications of European Patents EP No. 0488248 and EP No. 0491197A1, 2,5-diacylaminophenol couplers as described in U.S. Pat. No. 5,888,716, pyrazoloazole type cyan couplers having an electron attractive group or a group bonded to a hydrogen at the sixth position as described in U.S. Pat. Nos. 4,873,183 and 4,916,051, and particularly, pyrazoloazole type cyan couplers having a carbamoyl group at the sixth position as described in JP-A No. 8-171185, JP-A No. 8-311360 and JP-A No. 8-339060 are also preferable.

Also, besides diphenylimidazole type cyan couplers as described in JP-A No. 2-33144, 3-hydroxypyridine type cyan couplers (among these couplers, a coupler which is changed to two-equivalent couplers by allowing 4-equivalent coupler of the coupler (42) exemplified as specific examples to have a chlorine dissociable group and the couplers (6) and (9) are particularly preferable) as described in the specification of European Patent EP No. 0333185A2, cyclic active methylene type couplers (among these couples, the coupler examples 3, 8 and 34 exemplified as specific examples are particularly preferable) as described in JP-A No. 64-32260, pyrrolopyrazole type cyan couplers as described in the specification of European Patent EP No. 0456226A1 and pyrroloimidazole type cyan couplers as described in European Patent EP No. 0484909 may also be used.

Among these cyan couplers, pyrroloazole type cyan couplers represented by the formula (I) as described in JP-A No. 11-282138 are particularly preferable and paragraphs No. 0012 to No. 0059 including the exemplified cyan couplers (1) to (47) may be applied to the present patent application as it is and preferably incorporated as a part of the specification of the present patent applicataion.

As the magenta couplers used in the present invention, 5-pyrazolone type magenta couplers and pyrazoloazole type magenta couplers as described in the known literature tabulated as above. Among these couplers, pyrazolotriazole couplers in which a secondary or tertiary alkyl group is directly bonded to the second, third or sixth position of a pyrazolotriazole ring as described in JP-A No. 61-65245, pyrazoloazole couplers containing a sulfonamide group in the molecule as described in JP-A No. 61-65246, pyrazoloazole couplers containing an alkoxyphenylsulfonamide ballast group as described in JP-A No. 61-147254 and pyrazoloazole couplers having an alkoxy group or an aryloxy group at the sixth position as described in European Pat. Nos. 226,849A and No. 294,785A are preferably used in view of the hue or image stability and color developing ability.

Particularly, as the magenta coupler, pyrazoloazole couplers represented by the formula (M-1) described in JP-A No. 8-122984 are preferable. The paragraphs No. 0009 to No. 0026 are applied to the present patent as it is and incorporated as a part of the specification of the present application.

In addition to the above, pyrazoloazole couplers having a steric hindrance group at both the third and sixth positions as described in European Patent No. 854384 and No. 884640 are preferably used.

As the yellow coupler, other than the compounds described in the above table, acylacetoamide type yellow couplers having a three- to five-membered cyclic structure on an acyl group as described in the specification of European Patent EP No. 0447969A1, malondianilide type yellow couplers having a cyclic structure as described in the specification of European Patent EP No. 0482552A1, pyrrole-2 or 3-yl, orindole-2 or 3-ylcarbonyl acetic acid anilide type couplers as described in European Patent Applications Laid-open No. 953870A1, No. 953871A1, No. 953872A1, No. 953873A1, No. 953874A1 and No. 953875A1 and acylacetoamide type yellow couplers as described in the specification of U.S. Pat. No. 5,118,599 are preferably used. Among these compounds, acylacetoamide type yellow couplers in which the acyl group is 1-alkylcyclopropane-1-carbonyl group and malondianilide type yellow couplers in which one of the anilides constitutes an indoline ring are used particularly preferably. These couplers may be used either singly or in combinations.

In the present invention, known color mixing preventives may be used. Among these preventives, those described in the patents exemplified below are preferable.

For example, polymer redox compounds as described in JP-A No. 5-333501, phenidone or hydrazine type compounds as described in WO98/33760 and U.S. Pat. No. 4,923,787 and white couplers as described in JP-A No. 5-249637, JP-A No. 10-282615 and German Patent No. 19629142A1 may be used. When, particularly, the pH of a developing solution is raised to attain rapid developing, it is also preferable to use redox compounds as described in German Patent Nos. 19618786A1 and No. 19806846A1, European Patent No. 839,623A1 and No. 842,975A1 and French Patent No. 2760460A1.

In the present invention, it is preferable to use ultraviolet absorbers having a high molar extinction coefficient as the ultraviolet absorber. Examples of such a compound include compounds having a triazine skeleton. Preferable examples of these compounds include those described in JP-A No. 46-3335, JP-A No. 55-152776, JP-A No. 5-197074, JP-A No. 5-232630, JP-A No. 5-307232, JP-A No. 6-211813, JP-A No. 8-53427, JP-A No. 8-234364, JP-A No. 8-239368, JP-A No. 9-31067, JP-A No. 10-115898, JP-A No. 10-147577, JP-A No. 10-182621, JP-A No. 8-501291, European Patent No. 711,804A and German Patent No. 19739797A.

As antiseptics or mildewproof agents which may be used in the present invention, those described in JP-A No. 63-271247 are useful. As the hydrophilic colloid used in the photographic layer constituting the light-sensitive material, gelatins are preferable. The proportion of a heavy metal, such as, particularly, iron, copper, zinc or manganese, which is contained as impurities is preferably 5 ppm or less and more preferably 3 ppm or less.

The amount of calcium contained in the light-sensitive material is preferably 20 mg/m$^2$ or less, more preferably 10 mg/m$^2$ or less and most preferably 5 mg/m$^2$ or less.

In the present invention, a yellow micro dot pattern may be formed in advance on the light-sensitive material by pre-exposure before image information is supplied to make copy control as described in European Patent Nos. 0789270A1 and EP No. 0789480A1.

The light-sensitive material of the present invention is used in a print system using a common negative printer and besides, it is suitable to a scan-exposure system using a cathode ray tube (CRT).

An exposure apparatus with a cathode ray tube is simpler, more compact and more inexpensive than an apparatus using a laser. Also, the optical axis and color are controlled with ease in this apparatus with the cathode ray tube.

Various emitters which emit light in the spectrum region are used according to the need in a cathode ray tube used for image exposure. For example, any one or two or more of a red emitter, green emitter and blue emitter may be used singly or in combinations. The spectrum region is not limited to the above red, green or blue region. Phosphors which emit in a yellow, orange, violet or infrared region may be used. Particularly, cathode ray tubes which are provided with a combination of these emitters to emit a white color are frequently used.

In the case where the light-sensitive material is provided with plural light-sensitive layers respectively having a different distribution of spectral sensitivity and the cathode ray tube is provided with phosphors which emit lights in plural spectrum regions, the exposures of plural colors may be carried out at the same time, specifically, image signals of plural colors are input to the cathode ray tube to emit light from the surface of the tube. A method in which the image signal of each color is input one by one to emit each color light sequentially and the light is allowed to pass through a film which cuts colors other than the object color thereby performing exposure (exposure performed alternately side by side) may be adopted. In general, the exposure performed alternately side by side is better to attain high image quality because a cathode ray tube having high resolution can be used.

The light-sensitive material of the present invention is preferably used in a digital scan-exposure system using monochromatic high density light from a laser source such as a gas laser, light emitting diode, semiconductor laser or a secondary harmonic wave generation light source (SHG) obtained by combining a semiconductor laser or a solid state laser using a semiconductor laser as the excitation light source with a nonlinear optical crystal. It is preferable to use a semiconductor laser or a secondary harmonic wave generation light source (SHG) obtained by combining a semiconductor laser or a solid state laser with a nonlinear optical crystal in order to make the system compact and inexpensive. A semiconductor laser is preferably used and the use of a semiconductor laser as at least one of exposure light sources is desirable to design an apparatus to be compact and inexpensive and to have long life and high stability.

When such a scan-exposure light source is used, the maximum wavelength of spectral sensitivity may be arbitrarily designed depending on the wavelength of a scan-exposure light source to be used. In the case of the SHG light source obtained by combining a solid laser using a semiconductor laser as the excitation light source or a semiconductor laser with a nonlinear optical crystal, the oscillation wavelength of the laser can be reduced by half, making it possible to obtain blue or green light. Therefore, the light-sensitive material can be made to have the maximum of spectral sensitivity in each of general three wavelength regions of blue, green and red.

Exposure time in such a scan-exposure operation is preferably $10^{-}4$ seconds or less and more preferably $10^{-6}$ seconds or less provided that the exposure time is defined as the time required to expose each pixel size when the density of a pixel is designed to be 400 dpi.

Preferable scan-exposure systems applicable to the present invention are described in detail in the publications listed in the aforementioned table.

When the light-sensitive material of the present invention is exposed in a printer, a band stop filter as described in U.S. Pat. No. 4,880,726 is preferably used. This ensures that light color mixing is eliminated and color reproducibility is significantly improved.

For the treatment of the light-sensitive material of the present invention, treating raw materials and treating methods as described in JP-A No. 2-207250, page 26, right lower column, line 1 to page 34, right upper column, line 9 and JP-A No. 4-97355, page 5, left upper column, line 17 to page 18, right lower column, line 20 may be preferably applied. As the preservatives to be used in the developing solution, compounds described in the publications listed in the aforementioned table are preferably used.

As a method for developing the light-sensitive material of the present invention after it is exposed, a thermal developing system or the like using no process solution may be used in addition to a wet system including a method of developing using a conventional developing solution containing an alkaline agent and a developing agent and a method in which the light-sensitive material is made to self-contain a developing agent and an activator solution or the like such as an alkaline solution containing no developing agent is used to carry out developing. Particularly, the activator method is eased in the control and handling of the process solution and decreased in adverse effects on the environment when waste solutions are treated and is therefore a preferable method in view of environmental safeguard because no developing agent is contained in the process solution.

In the activator method, hydrazine type compounds as described in, for example, JP-A No. 8-234388, JP-A No. 9-152686, JP-A No. 9-152693, JP-A No. 9-211814 and JP-A No. 9-160193 are preferable as the developing agent which is self-contained in the light-sensitive material or its precursor.

Also, a developing method in which the amount of silver to be applied in the light-sensitive material and image amplifying treatment (intensifying treatment) using hydrogen peroxide is carried out is preferably used. Particularly it is preferable to use this method in the activator system. To state more concretely, an image forming method using an activator solution containing hydrogen peroxide as described in JP-A No. 8-297354 and JP-A No. 9-152695 is preferably used.

In the activator method, the light-sensitive material is usually subjected to desilverizing treatment after being treated by an activator solution. In the image amplifying treatment using a light-sensitive material having a low-silver content, a simple method in which the desilverizing treatment is omitted and washing with water or stabilizing treatment is carried out may be adopted. Also, in a method in which image information is read from a light-sensitive material by using a scanner or the like, a treating system requiring no desilverizing treatment may be adopted even in the case of using a light-sensitive material having high silver content such as light-sensitive materials for photographing.

As the activator solution, desilverizing solution (bleaching/fixing solution) and process materials and treating methods for washing with water and stabilizing solutions, known materials and methods may be used. Preferably, those described in Research Disclosure Item 36544 (September, 1994), pp536–541 and JP-A No. 8-234388 may be used.

In the present invention, the color developing time means the time passing since the light-sensitive material is put in a color developing solution until the light-sensitive material is put in a bleaching and fixing solution in the next step. For example, in the case where the light-sensitive material is treated using an automatic developing machine, the color developing time means the total of both the time (the so-called in-solution time) during which the light-sensitive material is immersed in the color developing solution and the time (the so-called in-air time) during which the light-sensitive material is taken out from the color developing solution and is carried in air towards a bleaching and fixing bath in the next step. Similarly, the bleaching and fixing time means the time passing since the light-sensitive material is put in the bleaching and fixing solution until the light-sensitive material is put in the next water-washing or stabilizing bath. Also, the water-washing or stabilizing time means the time (the so-called in-solution time) passing since the light-sensitive material is put in a water-washing or stabilizing bath until the light-sensitive material is allowed to remain in the solution towards to the next drying step.

In rapid treatment to be intended in the present invention, the color developing time is preferably 30 seconds or less, more preferably 20 seconds or less, still more preferably 20 seconds or less and 1 second or more (preferably 20 seconds or less and 5 seconds or more and further, 20 seconds or less and 7 seconds or more) and most preferably 15 seconds or less and 6 seconds or more. Similarly, the bleaching and fixing time is preferably 30 seconds or less, more preferably 20 seconds or less and most preferably 15 seconds or less and 6 seconds or more. Also, water-washing or stabilizing time is preferably 40 seconds or less, more preferably 30 seconds or less and most preferably 20 seconds or less and 6 seconds or more.

As a drying method in the present invention, any conventionally known method relative to rapid drying of a color photographic light-sensitive material may be used. However, it is preferable from the purpose of the present invention that the color photographic light-sensitive material can be dried within 20 seconds, preferably within 15 seconds and most preferably in 5 seconds to 10 seconds.

The drying system may be either a contact heating system or a hot air blasting system; however, a system structure of a combination of the contact heating system and the hot air blasting system is preferable because this system structure enables more rapid drying than in the case of using either one of the both system. A more preferable embodiment of the drying system in the present invention is a system in which the light-sensitive material is contact-heated using a heat roller and thereafter dried by air blasting using hot air brown off towards to the light-sensitive material from a perforated plate or nozzles. The mass velocity of the hot air blown per unit area of the heat receptive area of the light-sensitive material is preferably 1000 kg/m$^2$·hr in the air-blow drying section. Also, the blow-off opening preferably has a shape reduced in pressure drop and as the blow-off opening, those described in FIG. 7 to FIG. 15 of JP-A No. 9-33998 are exemplified.

The light-sensitive material of the present invention has rapid processability and high sensitivity, is reduced in pressure fogging and has adaptability not only to plane exposure but also, particularly, to scan-exposure at high illuminance. Therefore, a better image is obtained in the aforementioned color developing time.

EXAMPLES

The present invention will be explained in more detail by way of examples, which are not intended to be limiting of the present invention.

Example 1

Preparation of a Comparative Emulsion A 2.0 g of sodium chloride and 2.8 g of an inert gelatin were added to 1200 cm$^3$ of water. The solution was filled in a container kept at 33° C. and 45 cm$^3$ of an aqueous silver nitrate solution (18 g silver nitrate: Ag-1) and 45 cm$^3$ of an aqueous sodium chloride solution (6.2 g sodium chloride: X-1) were added to the solution by using a double jet method over one minute while the solution was stirred. 1 mmol of the following crystal habit control agent 1 and 290 g of an aqueous 10% phthalated gelatin solution were added one minute after the above addition was finished. After one minute, 2.0 g of sodium chloride was further added. The temperature of the reaction container was raised to 60 in the consecutive 25 minutes. After the resulting mixture was ripened at 60 for 18 minutes, 3.0 g of sodium chloride and 1 mmol of the crystal habit control agent 1 were added to the mixture. After that, 380 cm$^3$ of an aqueous silver nitrate solution (152 g: Ag-2) and 451 cm$^3$ of an aqueous sodium chloride solution (62 g sodium chloride: X-2) were added at an accelerated flow rate over 28 minutes. 85 cm$^3$ of an aqueous solution containing 1.5 mg of yellow prussiate of potash was added since when 21 minutes passed after the addition of the above component was started till when 28 minutes passed after the addition started. Further, blue-sensitive spectral sensitizing dyes A, B and C were added in a total amount of $8\times10^{-4}$ mol per 1 mol of silver, the temperature of the resulting mixture was raised to 75° C. and the mixture was allowed to stand for 30 minutes.

(Sensitizing dye A)

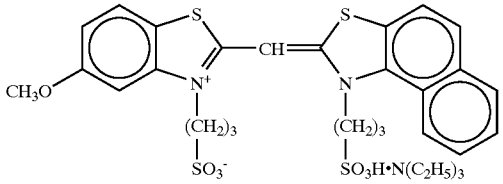

-continued (Sensitizing dye B)

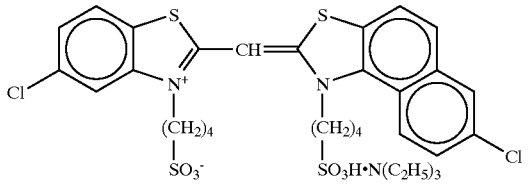

(Sensitizing dye C)

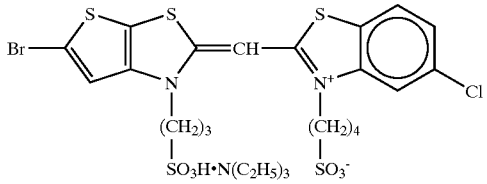

Crystal habit control agent 1

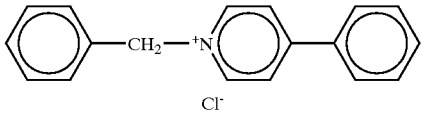

The resulting product was subjected to sedimentation-washing performed at 40° C. to desalt. To the desalted product was added 100 g of a gelatin treated with lime to adjust the product to pH 6.2 and pAg 7.0. Thereafter, a mixed solution of sodium thiosulfonate and sodium thiosulfinate ($4\times10^{-4}$ mol and $\times10^{-4}$ mol respectively per 1 mol of silver) was added. Chloroauric acid and 1-(3-methylureidophenyl)-5-mercaptotetrazole were used to perform chemical sensitization optimally. It was found from the electron microphotograph of the resulting particle that the particle was a tabular particle which had a {111} plane as its principal plane and the following properties: projected area equivalent diameter: 0.82 μm, thickness: 0.13 μm, aspect ratio: 6, sphere equivalent diameter: 0.5 μm, side length converted into that equivalent to a cubic and coefficient of variation: 0.25 (iodine content: 0 mol %, bromine content: 0 mol %).

Preparation of a Comparative Emulsion B

A process preceding to the step of adding blue-sensitive spectral sensitizing dyes was carried out in the same procedures as in the method of the production of the emulsion A. After that, the temperature was dropped to 30° C. and 2 mol % of an aqueous silver nitrate solution (Ag-3) and 2 mol % of an aqueous 2% potassium bromide solution (X-3) were added over 2 minutes at the same time. After that, blue-sensitive spectral sensitizing dyes A, B and C were added in a total amount of $8\times10^{-4}$ mol per 1 mol of silver and 12 g of sodium dodecylbenzenesulfonate (DBS) was added. The temperature was raised to 75° C. and the mixture was allowed to stand for 30 minutes.

Next, desalting and chemical sensitization were carried out in the same manner as in the preparation of the emulsion A.

The shape of the resulting particle was not different from that of the emulsion A. The content of bromine in the silver bromide layer of the outermost surface was measured using an X-ray photoelectron spectrometer JPS9000MX (manufactured by JEOL) equipped with a device capable of cooling the measurement sample to the liquid helium temperature. The number of mols of bromine of the sample on the basis of silver was calculated to find that it was 30%. In the following emulsions, the content of bromine was also measured using the same spectrometer.

Preparation of a Comparative Emulsion C

An emulsion C was prepared using the same method (including chemical sensitization) as in the preparation of the emulsion B except that an aqueous solution of iridium (IV) potassium hexachloride was added in an amount of $3\times10^{-7}$ mol per total silver when the aqueous silver nitrate solution (Ag-3) and the aqueous potassium bromide (X-3) were added at 30%. The content of bromine in the silver bromide layer was 30% which was the same as that of the emulsion B.

Preparation of a Comparative Emulsion D

An emulsion D was prepared using the same method as in the preparation of the emulsion A except that an aqueous solution containing 0.66 g of potassium iodide was added since when 21 minutes passed after the addition of (AG-2) and (X-2) was started until when 28 minutes passed after the addition was started. The shape of the resulting particle was not different from that of the emulsion A.

Preparation of a Comparative Emulsion E

An emulsion E was prepared using the same method as in the preparation of the emulsion D except that an aqueous solution containing iridium (IV) potassium hexachloride was further added in an amount of $3\times10^{-7}$ mol per total silver since when 21 minutes passed after the addition of (AG-2) and (X-2) was started until when 28 minutes passed after the addition was started. The shape of the resulting particle was not different from that of the emulsion D.

Preparation of a Comparative Emulsion F

An emulsion F was prepared using the same method as in the preparation of the emulsion C except that an aqueous solution containing 0.66 g of potassium iodide was added since when 21 minutes passed after the addition of (AG-2) and (X-2) was started until when 28 minutes passed after the addition was started and iridium (IV) potassium hexachloride was added over 15 seconds since when 1 minute passed after the addition of (AG-3) and (X-3) was started until when 1 minute and 15 seconds passed after the addition was started. The resulting particle had a shape with a projection on the top of the particle but the particle size was not different from that of the emulsion E. The content of bromine in the silver bromide layer was 20%.

Preparation of a Comparative Emulsion G

An emulsion G was prepared using the same method as in the preparation of the emulsion F except that 12 g of sodium chloride was added before (Ag-3) and (X-3) were added, the temperature was set to 45° C. and (Ag-3) and (X-3) were added but the aqueous iridium hexachloride solution was not added. The resulting particle had a shape in which the projection on the top of the particle was smaller than that of the emulsion F and was made angular but was not different from the emulsion F in particle size. The content of bromine in the silver bromide layer was 35%.

Preparation of a Comparative Emulsion H

An emulsion H was prepared using the same method as in the preparation of the emulsion G except that an aqueous solution containing iridium (IV) potassium hexachloride was added in an amount of $3\times10^{-7}$ mol per total silver over 2 minutes during which (AG-3) and (X-3) were added. The shape of the resulting particle was not different from that of the emulsion G. The content of bromine in the silver bromide layer was 35%.

Preparation of an Emulsion I of the Present Invention

An emulsion I was prepared using the same method as in the preparation of the emulsion H except that iridium (IV) potassium hexachloride was added over 15 seconds since when 1 minute passed after the addition of (AG-3) and (X-3) was started until when 1 minute and 15 seconds passed after the addition was started. The shape of the resulting particle was not different from that of the emulsion H. The content of silver bromide was 30%.

Preparation of an Emulsion J of the Present Invention

An emulsion J was prepared using the same method as in the method of preparing the emulsion I except that (Ag-3) and (X-3) were added at 75° C. The resulting particle had a shape more angular than that of the emulsion I but was not different from the emulsion I in particle size. The content of bromine in the silver bromide layer was 55%.

The surface of a support prepared by coating both surface of paper with a polyethylene resin was subjected to corona discharge treatment and thereafter a gelatin undercoat layer containing sodium dodecylbenzenesulfonate was formed on the surface of the support. Further, photographic structural layers consisting of a first layer to a seventh layer were formed by application in order to manufacture a sample (101) of a silver halide color photographic light-sensitive material having the following layer structure. A coating solution for each photographic structural layer was prepared in the following manner. Incidentally, after the coating solution was prepared, it was aged at 40° C. for 8 hours and then applied. Preparation of a first layer coating solution 57 g of a yellow coupler (ExY), 7 g of a color image stabilizer (Cpd-1), 4 g of a color image stabilizer (Cpd-2), 7 g of a color image stabilizer (Cpd-3) and 2 g of a color image stabilizer (Cpd-8) were dissolved in 21 g of a solvent (Solv-1) and 80 $cm^3$ of ethyl acetate. This solution was emulsion-dispersed in 220 g of an aqueous 23.5% by weight gelatin solution containing 4 g of sodium dodecylbenzenesulfonate by using a high speed stirring emulsifier (dissolver) and water was then added to the dispersion to prepare 900 g of an emulsion dispersion A.

On the other hand, the aforementioned emulsion dispersion A was mixed with the emulsion A to prepare a first layer coating solution such that the solution had the following composition. The amount of the emulsion to be applied shows the applied amount converted into the amount of silver.

Coating solutions for a second layer to a seventh layer were prepared in the same manner as in the preparation of the coating solution for the first layer. As the gelatin-hardener for each layer, sodium salts of 1-oxy-3,5-dichloro-s-triazine (H-1), (H-2) and (H-3) were used in a total amount of 100 $mg/m^2$. Also, Ab-1, Ab-2, Ab-3 and Ab-4 were added to each layer such that the total amounts were 15.0 $mg/m^2$, 60.0 $mg/m^2$, 5.0 $mg/m^2$ and 10.0 $mg/m^2$.

(H-1)

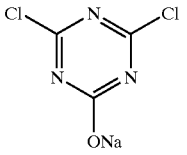

film hardener
(1.4% by weight per gelatin in use)

-continued (H-2)

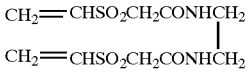

film hardener (H-3)

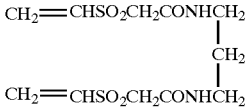

film hardener (Ab-1)

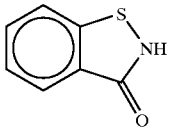

antiseptic (Ab-2)

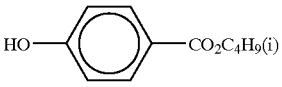

antiseptic (Ab-3)

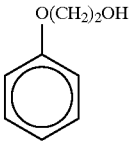

antiseptic

-continued (Ab-4)

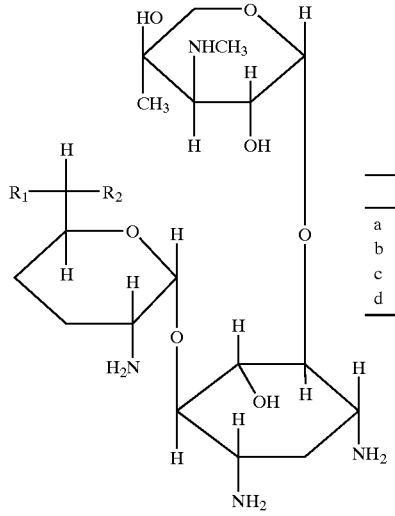

| | $R_1$ | $R_2$ |
|---|---|---|
| a | $CH_3$ | $NHCH_3$ |
| b | $CH_3$ | $NH_2$ |
| c | H | $NH_2$ |
| d | H | $NHCH_3$ |

antiseptic

Mixture of a, b, c and d (1:1:1:1) (mol ratio).

As the silver chlorobromide emulsion for green- and red-sensitive emulsion layers, the following spectral sensitizing dyes were respectively used. Green-sensitive emulsion layer (Sensitizing dye D)

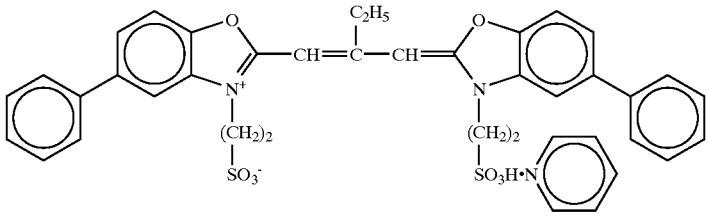

(Sensitizing dye E)

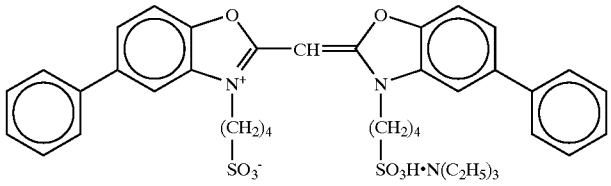

(Sensitizing dye F)

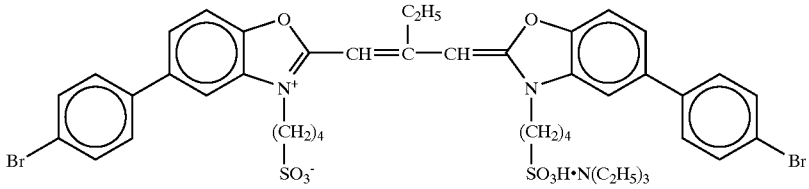

(The sensitizing dye D was added to a large size emulsion in an amount of $3.0\times10^{-4}$ mol and to a small size emulsion in an amount of $3.6\times10^{-4}$ mol per 1 mol of the silver halide, the sensitizing dye E was added to a large size emulsion in an amount of $4.0\times10^{-5}$ mol and to a small size emulsion in an amount of $7.0\times10^{-5}$ mol per 1 mol of the silver halide and the sensitizing dye F was added to a large size emulsion in an amount of $2.0\times10^{-4}$ mol and to a small size emulsion in an amount of $2.8\times10^{-4}$ mol per 1 mol of the silver halide.)

Red-sensitive emulsion layer (Sensitizing dye G)

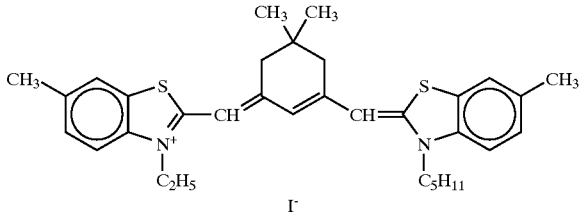

(Sensitizing dye H)

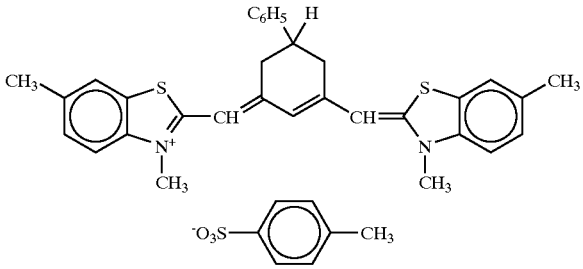

(The sensitizing dyes G and H were respectively added to a large size emulsion in an amount of $8.0\times10^{-5}$ mol and to a small size emulsion in an amount of $10.7\times10^{-5}$ mol per 1 mol of the silver halide.)

Further, the following compound I was added to the red-sensitive emulsion layer in an amount of $3.0\times10^{-3}$ mol per 1 mol of the silver halide.

(Compound I)

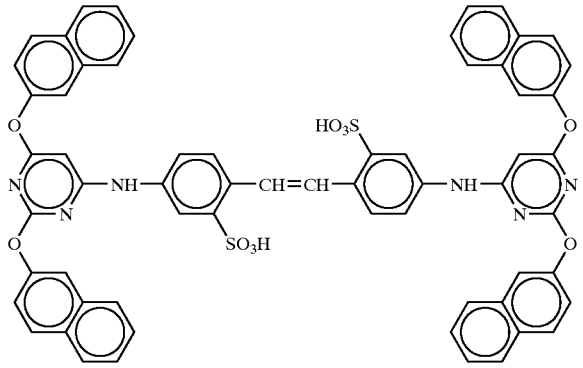

In addition, 1-(3-methylureidophenyl)-5-mercaptotetrazole was added to the blue-sensitive emulsion layer, green-sensitive emulsion layer and red-sensitive emulsion layer in amounts of $3.3\times10^{-4}$ mol, $1.0\times10^{-3}$ mol and $5.9\times10^{-4}$ mol per 1 mol of the silver halide respectively.

Further, 1-(3-methylureidophenyl)-5-mercaptotetrazole was also added to the second layer, fourth layer, sixth layer and seventh layer in amounts of 0.2 mg/m$^{2,}$ $^{0.2}$ mg/m$^2$, 0.6 mg/m$^2$ and 0.1 mg/m$^2$ respectively.

Also, 4-hydroxy-6-methyl-1,3,3a,7-tetrazaindene was added to the blue-sensitive layer and green-sensitive layer in an amount of $1\times10^{-4}$ mol and $2\times10^{-4}$ Mol per 1 mol of the silver halide respectively.

A copolymer latex made from methacrylic acid and butyl acrylate (ratio by weight: 1:1, average molecular weight: 200000 to 400000) was added to the red-sensitive emulsion layer in an amount of 0.05/m$^2$.

Disodium catechol-3,5-disulfonate was added to the second layer, fourth layer and sixth layer in amounts of 6 mg/m$^2$, 6mg/m$^2$ and 18 mg/m$^2$ respectively. Also, the following dye (the numeral in the parenthesis show the amount to be applied) was added to prevent irradiation.

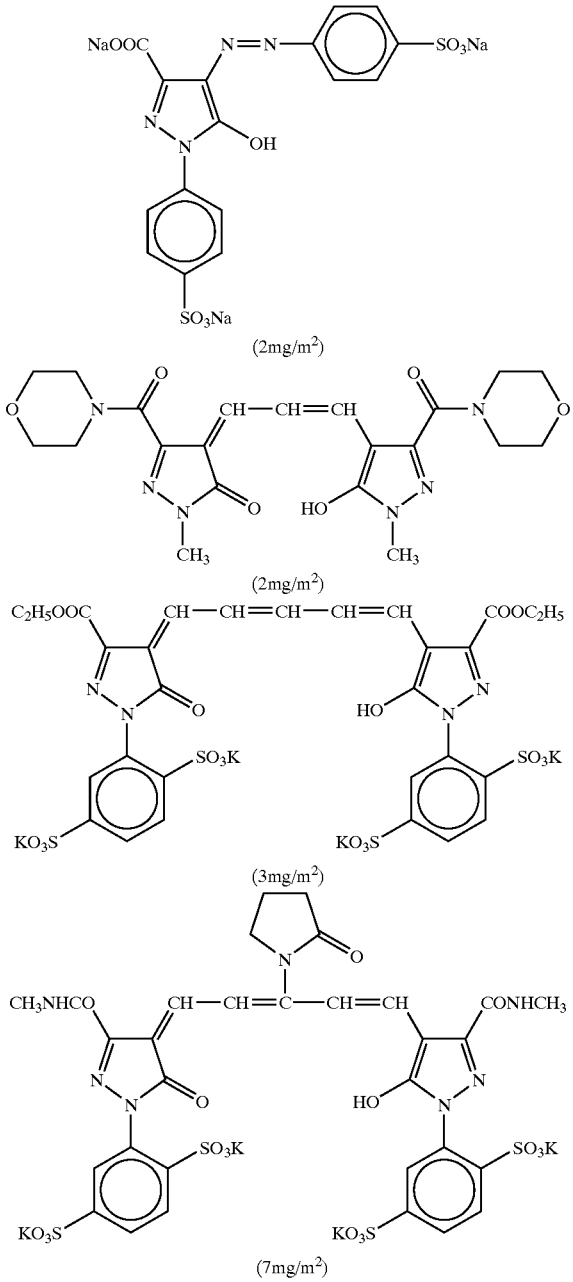

Layer Structure

The structure of each layer is shown below. The numerals show the amounts (g/m$^2$) to be applied. The numeral for each silver halide emulsion shows an amount converted into silver.

Support:

Polyethylene Resin-laminated Paper:

(The polyethylene resin of the first layer contains a white pigment ($TiO_2$; content: 16% by weight, ZnO; content: 4% by weight), a fluorescent whitening agent (4,4'-bis(5-methylbenzoxazolyl)stilbene, content: 0.03% by weight) and a blueing dye (ultramarine blue).)

First layer (blue-sensitive emulsion layer):

| | |
|---|---|
| First layer (blue-sensitive emulsion layer): | |
| Emulsion A | 0.24 |
| Gelatin | 1.25 |
| Yellow coupler (ExY) | 0.57 |
| Color image stabilizer (Cpd-1) | 0.07 |
| Color image stabilizer (Cpd-2) | 0.04 |
| Color image stabilizer (Cpd-3) | 0.07 |
| Color image stabilizer (Cpd-8) | 0.02 |
| Solvent (Solv-1) | 0.21 |
| Second layer (Color mixing preventive layer) | |
| Gelatin | 0.99 |
| Color mixing preventive (Cpd-4) | 0.09 |
| Color image stabilizer (Cpd-5) | 0.018 |
| Color image stabilizer (Cpd-6) | 0.13 |
| Color image stabilizer (Cpd-7) | 0.01 |
| Solvent (Solv-1) | 0.06 |
| Solvent (Solv-2) | 0.22 |
| Third layer (green-sensitive emulsion layer): | |
| Silver chlorobromide emulsion B | 0.14 |

(cubic, mixture of the large-size emulsion B having an average particle size of 0.45 μm and a small-size emulsion B having an average particle size of 0.35 μm (1:3) (silver mol ratio), coefficient of variation in the distribution of particle size: 0.10 and 0.08 respectively, in each emulsion having a different size, 0.4 mol % of silver bromide was contained so as to be localized in a part of the surface of the particle using silver chloride as its base material)

| | |
|---|---|
| Gelatin | 1.36 |
| Magenta coupler (ExM) | 0.15 |
| Ultraviolet absorber (UV-A) | 0.14 |
| Color image stabilizer (Cpd-2) | 0.02 |
| Color mixing preventive (Cpd-4) | 0.002 |
| Color image stabilizer (Cpd-6) | 0.09 |
| Color image stabilizer (Cpd-8) | 0.02 |
| Color image stabilizer (Cpd-9) | 0.03 |
| Color image stabilizer (Cpd-10) | 0.01 |
| Color image stabilizer (Cpd-11) | 0.0001 |
| Solvent (Solv-3) | 0.11 |
| Solvent (Solv-4) | 0.22 |
| Solvent (Solv-5) | 0.20 |
| Fourth layer (Color mixing preventive layer): | |
| Gelatin | 0.71 |
| Color mixing preventive (Cpd-4) | 0.06 |
| Color image stabilizer (Cpd-5) | 0.013 |
| Color image stabilizer (Cpd-6) | 0.10 |
| Color image stabilizer (Cpd-7) | 0.007 |
| Solvent (Solv-1) | 0.04 |
| Solvent (Solv-2) | 0.16 |
| Fifth layer (red-sensitive emulsion layer): | |
| Silver chlorobromide emulsion C | 0.12 |

(cubic, mixture of the large-size emulsion C having an average particle size of 0.40 μm and a small-size emulsion C having an average particle size of 0.30 μm (5:5) (silver mol ratio), coefficient of variation in the distribution of particle size: 0.09 and 0.11 respectively, in each emulsion having a different size, 0.8 mol % of silver bromide was contained so as to be localized in a part of the surface of the particle using silver chloride as its base material)

| | |
|---|---|
| Gelatin | 1.11 |
| Cyan coupler (ExC-2) | 0.13 |
| Cyan coupler (ExC-3) | 0.03 |
| Color image stabilizer (Cpd-1) | 0.05 |
| Color image stabilizer (Cpd-6) | 0.06 |
| Color image stabilizer (Cpd-7) | 0.02 |
| Color image stabilizer (Cpd-9) | 0.04 |
| Color image stabilizer (Cpd-10) | 0.01 |
| Color image stabilizer (Cpd-14) | 0.01 |
| Color image stabilizer (Cpd-15) | 0.12 |
| Color image stabilizer (Cpd-16) | 0.03 |
| Color image stabilizer (Cpd-17) | 0.09 |
| Color image stabilizer (Cpd-18) | 0.07 |
| Solvent (Solv-5) | 0.15 |
| Solvent (Solv-8) | 0.05 |
| Sixth layer (ultraviolet absorbing layer): | |
| Gelatin | 0.46 |
| Ultraviolet absorber (UV-B) | 0.45 |
| Compound (S1-4) | 0.0015 |
| Solvent (Solv-7) | 0.25 |
| Seventh layer (protective layer): | |
| Gelatin | 1.00 |
| Acryl denatured copolymer of polyvinyl alcohol (degree of denaturation: 17%) | 0.04 |
| Liquid paraffin | 0.02 |
| Surfactant (Cpd-13) | 0.01 |

(ExY) Yellow Coupler

Mixture of (Y1) and (Y2) (70:30) (mol ratio)

(Y1)

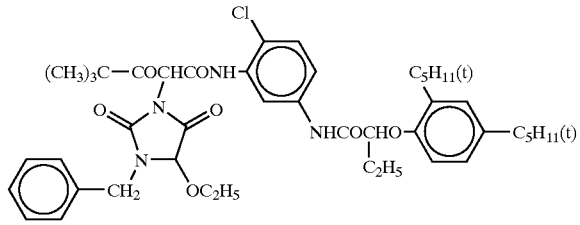

(Y2)

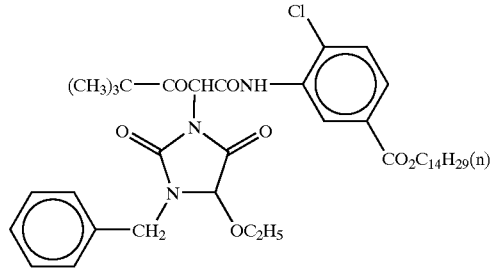

(ExM) Magenta Coupler
Mixture of (M1), (M2) and (M3) (40:40:20) (mol ratio)
(M1)
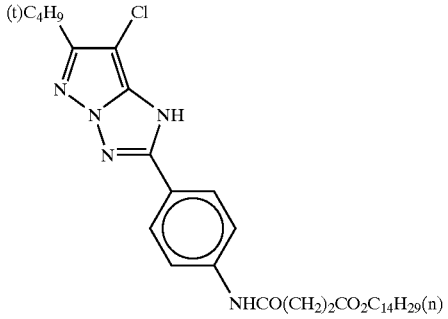
(M2)
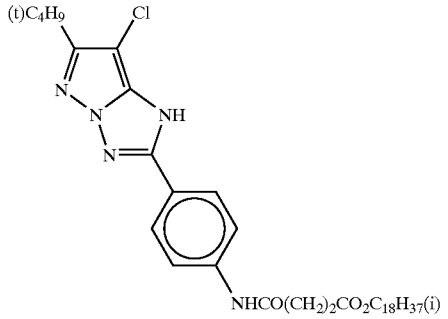
(M3)
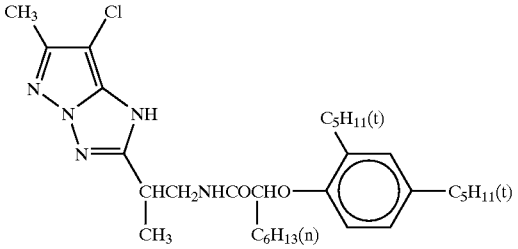
(ExC-2)
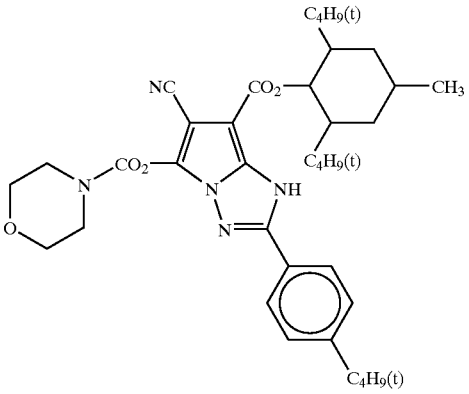
Cyan coupler
(ExC-3 ) Cyan Coupler
Mixture of (C1), (C2) and (C3) (50:25:25) (mol ratio)
Mixture of (C1), (C2) and (C3) (50:25:25) (mol ratio)
(C1)
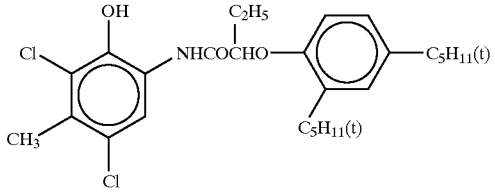
(C2)
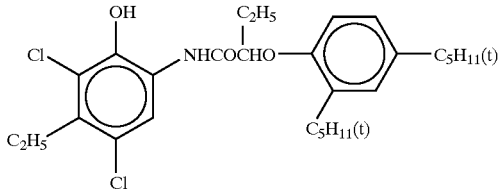
(C3)
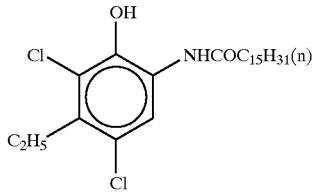
(Cpd-1)
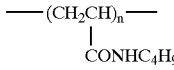
Color image stabilizer
Number average molecular weight: 60,000
(Cpd-2)
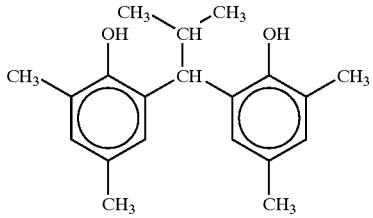
Color image stabilizer
(Cpd-3)
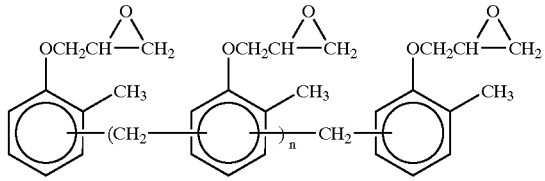
n = 7 to 8 (average)
Color image stabilizer
(Cpd-4)
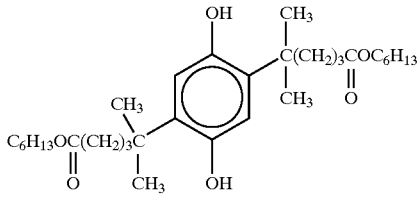
Color image stabilizer -continued
(Cpd-5)
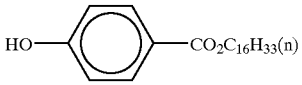
Color image stabilizer
(Cpd-6)
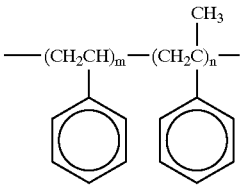
Number average molecular weight: 600
m/n = 10/90
Color image stabilizer
(Cpd-7)
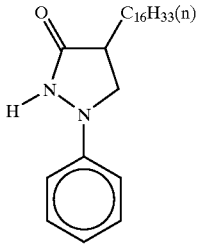
Color image stabilizer
(Cpd-8)
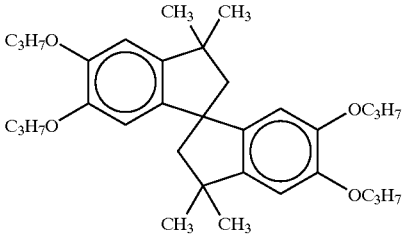
Color image stabilizer
(Cpd-9)
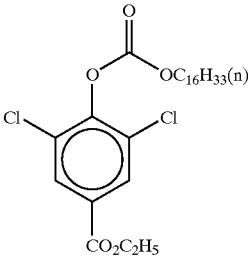
Color image stabilizer
(Cpd-10)
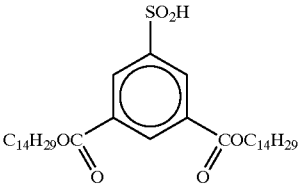
Color image stabilizer
-continued
(Cpd-11)
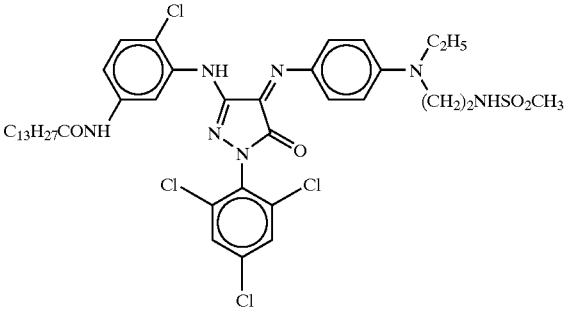
(Cpd-13)
Mixture of (S-1) and (S-2) (7:3) (mol ratio)
Surfactant
(S1)
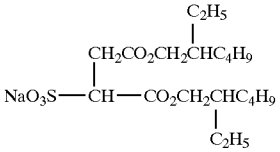
(S2)
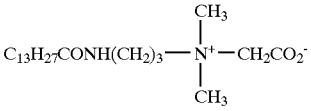
(Cpd-14)
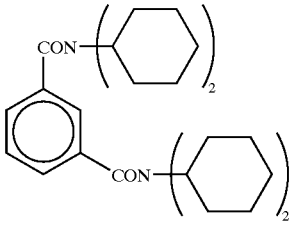
(Cpd-15)
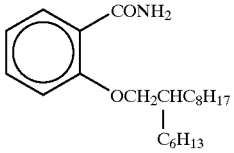
(Cpd-16)
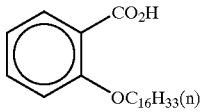
(Cpd-17)
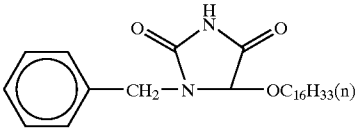
(Cpd-18)
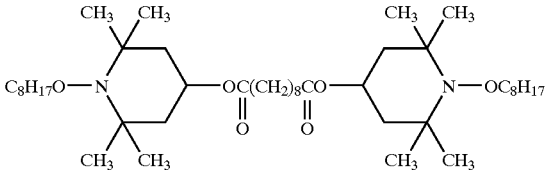

-continued (Cpd-19)

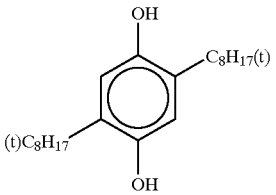

Color mixing preventive (UV-1)

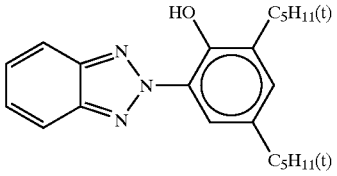

Ultraviolet absorber (UV-2)

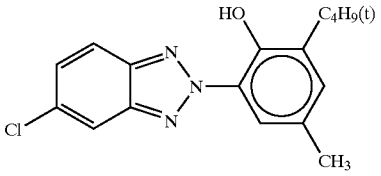

Ultraviolet absorber (UV-3)

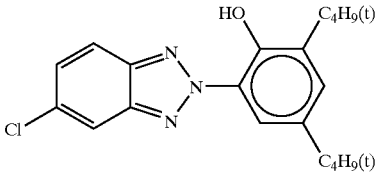

Ultraviolet absorber (UV-4)

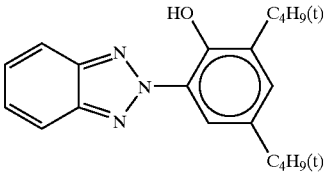

Ultraviolet absorber (UV-5)

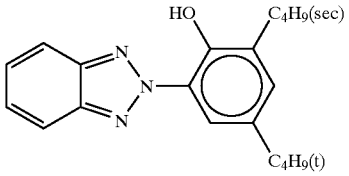

Ultraviolet absorber (UV-6)

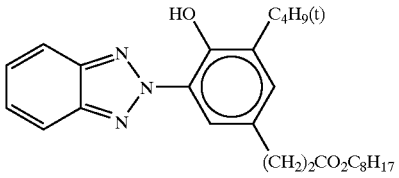

Ultraviolet absorber (UV-7)

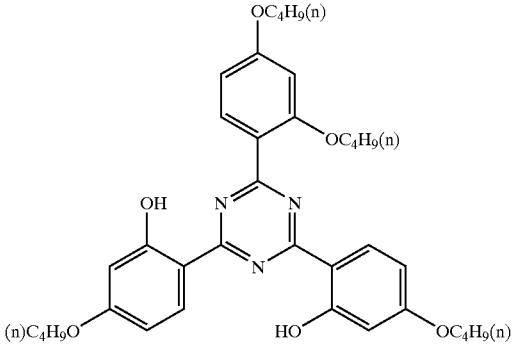

Ultraviolet absorber

UV-A: Mixture of UV-1/UV-2/UV-3/UV-4 (4/2/2/3) (weight ratio)

UV-B: Mixture of UV-1/UV-2/UV-3/UV-4/UV-5/UV-6 (9/3/3/4/5/3) (weight ratio)

UV-C: Mixture of UV-2/UV-3/UV-6/UV-7 (1/1/1/2) (weight ratio)

(Solv-1)

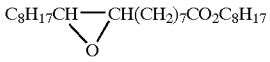

(Solv-2)

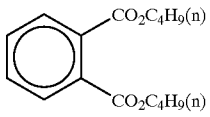

(Solv-3)

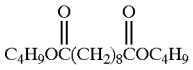

(Solv-4)

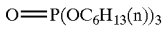

(Solv-5)

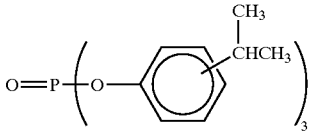

(Solv-7)

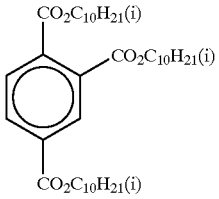

(Solv-8)

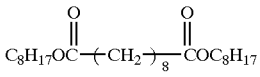

-continued (S1-4)

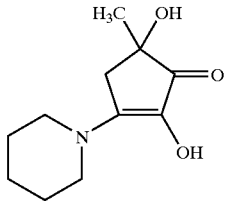

Coating samples (102) to (110) were prepared in the same manner as in the preparation of the sample (101) except that the emulsion A was altered to the emulsions B to J.

The following experiments were conducted to examine the photographic properties of these coating samples. Experiment 1 Exposure illuminance dependency of emulsions A to J Using a sensitometer (FWH model, manufactured by Fuji Photo Film), each coating sample was subjected to gradation exposure for sensitometry, wherein the sample was exposed at a low illuminance for 10 seconds by using the sensitometer equipped with an SP-1 filter.

Each sample was also subjected to gradation exposure for sensitometry which was carried out using a sensitometer for high illuminance exposure (HIE model, manufactured by Yamashita Denso), wherein the sample was exposed at a high illuminance for $10^{-4}$ seconds by using the sensitometer equipped with an SP-1 filter.

Color development processing A shown below was carried out 60 minutes after the exposure was finished.

Treating steps are shown below.

Treatment A

The above light-sensitive material 101 was processed into a 127-mm-wide roll. After imagewise exposure, the light-sensitive material was subjected to continuous treatment (running test) involving the following steps using a mini laboratory printer processor PP1258AR manufactured by Fuji Photo Film, the treatment being performed until a replenishing solution was supplied two times the capacity of a color developing tank. This treatment using this running solution was referred to as treatment A.

| Treating steps | Temperature | Time | Replenished amount* |
|---|---|---|---|
| Color developing | 38.5° C. | 45 sec | 45 $cm^3$ |
| Bleaching /fixing | 38.0° C. | 45 sec | 35 $cm^3$ |
| Rinse (1) | 38.0° C. | 20 sec | — |
| Rinse (2) | 38.0° C. | 20 sec | — |
| Rinse (3) | **38.0° C. | 20 sec | — |
| Rinse (4) | **38.0° C. | 30 sec | 121 $cm^3$ |

*Replenished amount per 1 $m^2$ of the light-sensitive material.

** A rinse cleaning system RC50D manufactured by Fuji Photo Film was installed in the rinse step (3), a rinse solution was withdrawn from the rinse step (3) and supplied to a reverse osmosis membrane module (RC50D) through a pump. The permeated solution obtained in a vessel of the module was supplied to the rinse step (4) and the concentrated solution was returned to the rinse step (3). Pump pressure was controlled such that the amount of the solution to be permeated in the reverse osmosis module was kept at a rate of 50 to 300 $cm^3$/min and the solution was circulated under controlled temperature for 10 hours a day.

* * A rinse cleaning system RC50D manufactured by Fuji Photo Film was installed in the rinse step (3), a rinse solution was withdrawn from the rinse step (3) and supplied to a reverse osmosis membrane module (RC50D) through a pump. The permeated solution obtained in a vessel of the module was supplied to the rinse step (4) and the concentrated solution was returned to the rinse step (3). Pump pressure was controlled such that the amount of the solution to be permeated in the reverse osmosis module was kept at a rate of 50 to 300 $cm^3$/min and the solution was circulated under controlled temperature for 10 hours a day.

(The rinsing was designed to be performed in a tank counter-current system from the step (1) to the step (4).) The composition of each process solution is as follows.

| | (tank solution) | (Replenishing solution) |
|---|---|---|
| (Color developing solution) | | |
| Water | 800 $cm^3$ | 800 $cm^3$ |
| Dimethylpolysiloxane type surfactant (Silicone KF351A manufactured by Shin-Etsu Chemical) | 0.1 g | 0.1 g |
| Tri(isopropanol)amine | 8.8 g | 8.8 g |
| Ethylenediaminetetraacetic acid | 4.0 g | 4.0 g |
| Polyethylene glycol (molecular weight: 300) | 10.0 g | 10.0 g |
| Sodium 4,5-dihydroxybenzene-1,3-disulfonate | 0.5 g | 0.5 g |
| Potassium chloride | 10.0 g | — |
| Potassium bromide | 0.040 g | 0.010 g |
| Triazinylaminostilbene type fluorescent whitening agent (Hakkol FWA-SF/manufactured by Showa Kagakusha) | 2.5 g | 5.0 g |
| Sodium sulfite | 0.1 g | 0.1 g |
| Disodium-N,N-bis(sulfonatoethyl) hydroxylamine | 8.5 g | 11.1 g |
| N-ethyl-N-(β-methanesulfonamido-ethyl)-3-methyl-4-amino-4-aminoaniline · 3/2 sulfuric acid · 1 hydrate salt | 5.0 g | 15.7 g |
| Potassium carbonate | 26.3 g | 26.3 g |
| Balanced by water | 1000 $cm^3$ | 1000 $cm^3$ |
| pH (25° C./adjusted by potassium hydroxide and sulfuric acid) | 10.15 | 12.50 |
| (Bleaching/fixing solution) | | |
| Water | 700 $cm^3$ | 600 $cm^3$ |
| Iron (III) ammonium ethylenediaminetetraacetate | 47.0 g | 94.0 g |
| Ethylenediaminetetraacetic acid | 1.4 g | 2.8 g |
| m-Carboxybenzenesulfinic acid | 8.3 g | 16.5 g |
| Nitric acid (67%) | 16.5 g | 33.0 g |
| Imidazole | 14.6 g | 29.2 g |
| Ammonium thiosulfate (750 g/1000 $cm^3$) | 107.0 $cm^3$ | 214.0 $cm^3$ |
| Ammonium sulfite | 16.0 g | 32.0 g |
| Ammonium bisulfite | 23.1 g | 46.2 g |
| Balanced by water | 1000 $cm^3$ | 1000 $cm^3$ |
| pH (25° C./adjusted by acetic acid and ammonia) | 6.0 | 6.0 |
| (Rinse solution) | | |
| Sodium chloroisocyanurate | 0.02 g | 0.02 g |
| Deionized water (conductivity: 5 μS/cm or less) | 1000 $cm^3$ | 1000 $cm^3$ |
| pH | 6.5 | 6.5 |

The developed yellow color density of each sample after treated was measured to find the 10 second exposure-low illuminance sensitivity and $10^{-4}$ second exposure-high illuminance sensitivity of each of the emulsions A to J. The sensitivity was defined as the inverse number of an exposure giving a developed density 1.0 higher than the lowest developed color density and expressed by a relative value when the sensitivity of the sample (101) in development processing was set to 100. Also, the gradation was found from the gradient between that sensitivity point and the sensitivity point giving a density of 1.5. Further, the developed color density in the unexposed portion was found. Experiment 2 Time dependency until treatment after exposure.

Moreover, the sensitometry of each sample was measured while the time period since the aforementioned $10^{-4}$ second high illuminance exposure until the treatment A was changed to find a difference in sensitivity between treatments after 60 minutes and 7 seconds.

The results of Experiments 1 and 2 are listed in Tables 2 and 3. As is clear from the results, the outermost layer of silver bromide increased the developed color density in the unexposed portion. (Emulsions B, Cvs. Emulsion A) Also, the silver chloroiodide emulsion having no silver bromide layer also increased the developed color density in the unexposed portion. (Emulsions D and E vs. Emulsion A) However, surprisingly, the developed color density was not increased when the silver chloroiodide emulsion was provided with the outermost layer of silver bromide. (Emulsions F to J vs. Emulsion A) Moreover, when a portion limited to the inside of the outermost layer is doped with an iridium compound, the high illuminance reciprocity failure was improved while the time dependency until treatment after exposure was kept small. (Emulsions I and J vs. Emulsions F to H) Only the emulsions of the present invention suppressed an increase in both the high illuminance reciprocity failure of an emulsion and the developed color density in the unexposed portion.

TABLE 2

| No. of samples | Names of emulsions | 10 second-exposure | | $10^{-4}$ second-exposure | | | | |
|---|---|---|---|---|---|---|---|---|
| | | Sensitivity | Gradation | Sensitivity | Gradation | Difference in sensitivity between 60 minutes and 7 seconds after exposure | Dmin | Remarks |
| 101 | Emulsion A | 100 | 1.5 | 100 | 1.0 | 12 | 0.08 | Comparative Example |
| 102 | Emulsion B | 125 | 1.5 | 125 | 1.0 | 12 | 0.10 | Comparative Example |
| 103 | Emulsion C | 125 | 1.5 | 110 | 1.6 | 70 | 0.10 | Comparative Example |
| 104 | Emulsion D | 300 | 2.8 | 300 | 1.5 | 12 | 0.15 | Comparative Example |
| 105 | Emulsion E | 300 | 2.8 | 850 | 3.2 | 65 | 0.18 | Comparative Example |
| 106 | Emulsion F | 310 | 2.8 | 900 | 3.2 | 80 | 0.09 | Comparative Example |
| 107 | Emulsion G | 350 | 2.8 | 350 | 2.0 | 12 | 0.07 | Comparative Example |
| 108 | Emulsion H | 350 | 2.8 | 900 | 3.2 | 50 | 0.07 | Comparative Example |
| 109 | Emulsion I | 390 | 3.6 | 900 | 3.6 | 12 | 0.07 | Present invention |
| 110 | Emulsion J | 390 | 3.6 | 900 | 3.6 | 10 | 0.08 | Present invention |

TABLE 3

| Emulsion | Halogen composition | | | Content of Br in the outermost layer | Ir doping | Stability of a | | | Remarks |
|---|---|---|---|---|---|---|---|---|---|
| | Cl | Br | I | | | HIRF | latent image | Fogging | |
| A | 100 | — | — | — | None | x | ○ | ○ | Comparative Example |
| B | 98 | 2 | — | 30% | None | x | ○ | x | Comparative Example |
| C | 98 | 2 | — | 30% | Doped (limited) | ○ | xx | x | Comparative Example |
| D | 99.6 | — | 0.4 | — | None | x | ○ | x | Comparative Example |
| E | 99.6 | — | 0.4 | — | Doped | ○ | xx | x | Comparative Example |
| F | 97.6 | 2 | 0.4 | 20% | Doped | ○ | xx | Δ | Comparative Example |
| G | 97.6 | 2 | 0.4 | 35% | None | x | ○ | ○ | Comparative Example |
| H | 97.6 | 2 | 0.4 | 35% | Doped (uniform) | ○ | x | ○ | Comparative Example |
| I | 97.6 | 2 | 04. | 30% | Doped | ○ | ○ | ○ | Present invention |
| J | 97.6 | 2 | 0.4 | 55% | Doped | ○ | ◎ | ○ | Present invention |

◎ Particularly good
○ Good
Δ Fair
x Bad with problems
xx very bad

Example 2

Metal compounds to be introduced into the outermost layer by doping were examined.

Preparation of a Comparative Emulsion K

An emulsion K was prepared in the same manner as in the preparation of the emulsion J except that the aqueous solution of iridium (IV) potassium hexachloride was not added.

Preparation of a Comparative Emulsion L

An emulsion L was prepared in the same manner as in the preparation of the emulsion J except that calcium chloride was added as an aqueous solution in an amount of $1\times10^{-5}$ mol based on the total silver in place of the aqueous solution of iridium (IV) potassium hexachloride.

Preparation of an Emulsion M of the Present Invention

An emulsion M was prepared in the same manner as in the preparation of the emulsion J except that yellow prussiate of potash was added as an aqueous solution in an amount of $1\times10^{-5}$ mol based on the total silver in place of the aqueous solution of iridium (IV) potassium hexachloride.

Preparation of an Emulsion N of the Present Invention

An emulsion N was prepared in the same manner as in the preparation of the emulsion J except that potassium hexachlororhodate was added as an aqueous solution in an amount of $\times10^{-9}$ mol based on the total silver in place of the aqueous solution of iridium (IV) potassium hexachloride.

Preparation of an Emulsion O of the Present Invention

An emulsion O was prepared in the same manner as in the preparation of the emulsion J except that iridium (IV) potassium pentachlorothiazole was added as an aqueous solution in an amount of $\times10^{-6}$ mol based on the total silver in place of the aqueous solution of iridium (IV) potassium hexachloride.

Using the emulsions K to O, samples (201) to (205) were produced respectively in the same manner as in the preparation of the sample 101 and subjected to the same experiments 1 and 2 as in Example 1.

As a result, the samples other than the sample (202) using no the compound of a metal from column VIII in contrast to the sample (201) could suppress increases in the high illuminance reciprocity failure and in the developed color density in the unexposed portion.

Example 3

The region within which a metal compound must be confined was examined.

Preparation of a Comparative Emulsion P

An emulsion P was prepared using the same method as in the preparation of the emulsion J except that the aqueous iridium (IV) potassium hexachloride solution was added successively in the same amount as above for 2 minutes during which (Ag-3) and (X-3) were added instead of adding the aqueous iridium (IV) potassium hexachloride solution for a time period limited to 15 seconds since when 1 minute passed after the addition of (Ag-3) and (X-3) was started until when 1 minute and 15 seconds passed after the addition was started.

Preparation of a Comparative Emulsion Q

An emulsion Q was prepared using the same method as in the preparation of the emulsion P except that the aqueous iridium (IV) potassium hexachloride solution was added successively in the same amount as above for a time period since when 12 seconds passed after the addition of (Ag-3) and (X-3) was started until the addition was finished.

Preparation of a Comparative Emulsion R

An emulsion R was prepared using the same method as in the preparation of the emulsion P except that the aqueous iridium (IV) potassium hexachloride solution was added successively in the same amount as above for a time period since just when the addition of (Ag-3) and (X-3) was started until when 108 seconds passed after the addition was started.

Preparation of an Emulsion S of the Present Invention

An emulsion S was prepared using the same method as in the preparation of the emulsion P except that the aqueous iridium (IV) potassium hexachloride solution was added successively in the same amount as above for a time period since when 12 seconds passed after the addition of (Ag-3) and (X-3) was started until when 108 seconds passed after the addition was started.

Preparation of an Emulsion T of the Present Invention

An emulsion T was prepared using the same method as in the preparation of the emulsion P except that the aqueous iridium (IV) potassium hexachloride solution was added successively in the same amount as above for a time period since when 30 seconds passed after the addition of (Ag-3) and (X-3) was started until when 60 seconds passed after the addition was started.

Using the emulsions P to T, samples (301) to (305) were produced respectively in the same manner as in the preparation of the sample 101 and subjected to the same experiments 1 and 2 as in Example 1.

As a result, the samples other than the samples (302) and (303) in which an iridium compound was not limited in the inside of the outermost layer in contrast to the sample (301) could suppress increases in the high illuminance reciprocity failure and in the developed color density in the unexposed portion.

Example 4

Necessary amounts of silver iodide and silver bromide to be contained were examined.

Preparation of a Comparative Emulsion U

An emulsion U was prepared in the same manner as in the preparation of the emulsion J except that the amount of potassium iodide was altered to 1.65 g.

Preparation of an Emulsion V of the Present Invention

An emulsion V was prepared in the same manner as in the preparation of the emulsion J except that the amount of potassium iodide was altered to 1.23 g.

Preparation of an Emulsion W of the Present Invention

An emulsion W was prepared in the same manner as in the preparation of the emulsion J except that the amount of potassium iodide was altered to 0.08 g.

Preparation of a Comparative Emulsion X

An emulsion X was prepared in the same manner as in the preparation of the emulsion J except that the amount of potassium bromide (X-3) was altered to 4.76 g from 2.38 g and along with this alteration, the amount of silver nitrate (Ag-3) was increased by an equivalent amount.

Preparation of an Emulsion Y of the Present Invention

An emulsion Y was prepared in the same manner as in the preparation of the emulsion J except that the amount of potassium bromide (X-3) was altered to 0.6 g from 2.38 g and along with this alteration, the amount of silver nitrate (Ag-3) was decreased by an equivalent amount.

Preparation of an Emulsion Z of the Present Invention

An emulsion Z was prepared in the same manner as in the preparation of the emulsion J except that the amount of potassium bromide (X-3) was altered to 0.12 g from 2.38 g and along with this alteration, the amount of silver nitrate (Ag-3) was decreased by an equivalent amount.

Using the emulsions U to Z, samples (401) to (406) were produced respectively in the same manner as in the preparation of the sample 101 and subjected to the same experiments 1 and 2 as in Example 1.

As a result, the emulsions in which the contents of silver iodide and silver bromide respectively fell in the range defined in the present invention could suppress the high illuminance reciprocity failure and an increase in the developed color density in the unexposed portion.

Example 5

Samples which were thin-layered by changing the layer structures to those shown below. Using these samples, the experiments 1 and 2 were carried out.

The layer structure is represented by that of the sample (501). It is to be noted that the samples (502) to (526) are those obtained by changing the emulsion A of the sample (501) to the emulsions B to Z respectively. Also, the numerals show the amounts (g/m$^2$) to be applied.

The same results as in Example 1 were obtained, specifically, each sample of the examples of the present invention could suppress both the high illuminance reciprocity failure and an increase in the developed color density in the unexposed portion. From these results, the effect of the present invention was confirmed in the ultra-rapid treatment of the thin-layered sample.

Preparation of a Sample 501:

First layer (blue-sensitive emulsion layer):

| | |
|---|---|
| First layer (blue-sensitive emulsion layer): | |
| Emulsion A | 0.24 |
| Gelatin | 1.25 |
| Yellow coupler (ExY) | 0.57 |
| Color image stabilizer (Cpd-1) | 0.07 |
| Color image stabilizer (Cpd-2) | 0.04 |
| Color image stabilizer (Cpd-3) | 0.07 |
| Color image stabilizer (Cpd-8) | 0.02 |
| Solvent (Solv-1) | 0.21 |
| Second layer (Color mixing preventive layer) | |
| Gelatin | 0.60 |
| Color mixing preventive (Cpd-19) | 0.09 |
| Color image stabilizer (Cpd-5) | 0.007 |
| Color image stabilizer (Cpd-7) | 0.007 |
| Ultraviolet absorber (UV-C) | 0.05 |
| Solvent (Solv-5) | 0.11 |
| Third layer (green-sensitive emulsion layer): | |
| Silver chlorobromide emulsion B (the same emulsion as in the sample 101) | 0.14 |
| Gelatin | 0.73 |
| Magenta coupler (ExM) | 0.15 |
| Ultraviolet absorber (UV-A) | 0.05 |
| Color image stabilizer (Cpd-2) | 0.02 |
| Color image stabilizer (Cpd-7) | 0.008 |
| Color image stabilizer (Cpd-8) | 0.07 |
| Color image stabilizer (Cpd-9) | 0.03 |
| Color image stabilizer (Cpd-10) | 0.009 |
| Color image stabilizer (Cpd-11) | 0.0001 |
| Solvent (Solv-3) | 0.06 |
| Solvent (Solv-4) | 0.11 |
| Solvent (Solv-5) | 0.06 |
| Fourth layer (Color mixing preventive layer): | |
| Gelatin | 0.48 |
| Color mixing preventive (Cpd-4) | 0.07 |
| Color image stabilizer (Cpd-5) | 0.006 |
| Color image stabilizer (Cpd-7) | 0.006 |
| Ultraviolet absorber (UV-C) | 0.04 |
| Solvent (Solv-5) | 0.09 |
| Fifth layer (red-sensitive emulsion layer): | |
| Silver chlorobromide emulsion C (the same emulsion as in the sample 101) | 0.12 |
| Gelatin | 0.59 |
| Cyan coupler (ExC-2) | 0.13 |
| Cyan coupler (ExC-3) | 0.03 |
| Color image stabilizer (Cpd-7) | 0.01 |
| Color image stabilizer (Cpd-9) | 0.04 |
| Color image stabilizer (Cpd-15) | 0.19 |
| Color image stabilizer (Cpd-18) | 0.04 |
| Ultraviolet absorber (UV-7) | 0.02 |
| Solvent (Solv-5) | 0.09 |
| Sixth layer (ultraviolet absorbing layer): | |
| Gelatin | 0.32 |
| Ultraviolet absorber (UV-C) | 0.42 |
| Solvent (Solv-7) | 0.08 |
| Seventh layer (protective layer): | |
| Gelatin | 0.70 |
| Acryl denatured copolymer of polyvinyl alcohol (degree of denaturation: 17%) | 0.04 |
| Liquid paraffin | 0.01 |
| Surfactant (Cpd-13) | 0.01 |
| polydimethylsiloxane | 0.01 |
| Silicon dioxide | 0.003 |

Each produced sample was exposed in the same manner as in the experiments 1 and 2 of Example 1 and subjected to color development processing which was super rapid treatment according to the development processing B shown below.

Treatment B

The above light-sensitive material 501 was processed into a 127-mm-wide roll and the sample of each light-sensitive material was exposed imagewise from a negative film having an average density by using an experimental process apparatus obtained by modifying a mini laboratory printer processor PP350 manufactured by Fuji Photo Film so as to change treating time and temperature. Thereafter, the sample was subjected to continuous treatment (running test) involving the following steps, the treatment being performed until the volume of a color developing replenishing solution to be supplied was 0.5 times the capacity of a color developing tank. This treatment using the running solution was referred to as treatment B.

| Treating steps | Temperature | Time | Replenished amount* |
|---|---|---|---|
| Color developing | 45.0° C. | 15 sec | 45 $cm^3$ |
| Bleaching /fixing | 40.0° C. | 15 sec | 35 $cm^3$ |
| Rinse (1) | 40.0° C. | 8 sec | — |
| Rinse (2) | 40.0° C. | 8 sec | — |

-continued

| Treating steps | Temperature | Time | Replenished amount* |
|---|---|---|---|
| Rinse (3) | **40.0° C. | 8 sec | — |
| Rinse (4) | **38.0° C. | 8 sec | 121 $cm^3$ |

* Replenished amount per 1 $m^2$ of the light-sensitive material.

** A rinse cleaning system RC50D manufactured by Fuji Photo Film was installed in the rinse step (3), a rinse solution was withdrawn from the rinse step (3) and supplied to a reverse osmosis membrane module (RC50D) through a pump. The permeated solution obtained in a vessel of the module was supplied to the rinse step (4) and the concentrated solution was returned to the rinse step (3). Pump pressure was controlled such that the amount of the solution to be permeated in the reverse osmosis module was kept at a rate of 50 to 300 $cm^3$/min and the solution was circulated under controlled temperature for 10 hours a day. The rinsing was designed to be performed in a tank counter-current systems from the step (1) to the step (4).

* * A rinse cleaning system RC50D manufactured by Fuji Photo Film was installed in the rinse step (3), a rinse solution was withdrawn from the rinse step (3) and supplied to a reverse osmosis membrane module (RC50D) through a pump. The permeated solution obtained in a vessel of the module was supplied to the rinse step (4) and the concentrated solution was returned to the rinse step (3). Pump pressure was controlled such that the amount of the solution to be permeated in the reverse osmosis module was kept at a rate of 50 to 300 $cm^3$/min and the solution was circulated under controlled temperature for 10 hours a day. The rinsing was designed to be performed in a tank counter-current system from the step (1) to the step (4).

The composition of each process solution is as follows.

| | (tank solution) | (Replenishing solution) |
|---|---|---|
| (Color developing solution) | | |
| water | 800 $cm^3$ | 800 $cm^3$ |
| Fluorescent whitening agent (FL-1) | 5.0 g | 8.5 g |
| Tri(isopropanol)amine | 8.8 g | 8.8 g |
| Sodium p-toluenesulfonate | 20.0 g | 20.0 g |
| Ethylenediaminetetraacetic acid | 4.0 g | 4.0 g |
| Sodium sulfite | 0.10 g | 0.50 g |
| Potassium chloride | 10.0 g | — |
| Sodium 4,5-dihydroxybenzene-1,3-disulfonate | 0.50 g | 0.50 g |
| Disodium-N,N-bis(sulfonatoethyl)hydroxylamine | 8.5 g | 14.5 g |
| 4-amino-3-methyl-N-ethyl-N-(β-methanesulfonamidoethyl)aniline.3/2 sulfate.monohydrate | 10.0 g | 22.0 g |
| Potassium carbonate | 26.3 g | 26.3 g |
| Balanced by water | 1000 $cm^3$ | 1000 $cm^3$ |
| pH (25° C., adjusted by sulfuric acid and potassium hydroxide) | 10.35 | 12.6 |
| (Bleaching/fixing solution) | | |
| Water | 800 $cm^3$ | 800 $cm^3$ |
| Ammonium thiosulfate (750 g/$cm^3$) | 107 $cm^3$ | 214 $cm^3$ |
| Succinic acid | 29.5 g | 59.0 g |
| Iron (III) ammonium | 47.0 g | 94.0 g |
| Ethylenediaminetetraacetate Ethylenediaminetetraacetic acid | 1.4 g | 2.8 g |
| Nitric acid (67%) | 17.5 g | 35.0 g |
| Imidazole | 14.6 g | 29.2 g |
| Ammonium sulfite | 16.0 g | 32.0 g |
| Potassium methabisulfite | 23.1 g | 46.2 g |
| Balanced by water | 1000 $cm^3$ | 1000 $cm^3$ |
| pH (25° C./adjusted by nitric acid and aqueous ammonia) | 6.00 | 6.00 |
| (Rinse solution) | | |
| Sodium chloroisocyanurate | 0.02 g | 0.02 g |
| Deionized water (conductivity: 5 μs/cm or less) | 1000 $cm^3$ | 1000 $cm^3$ |
| PH (25° C.) | 6.5 | 6.5 |

-continued (tank solution) (Replenishing solution)

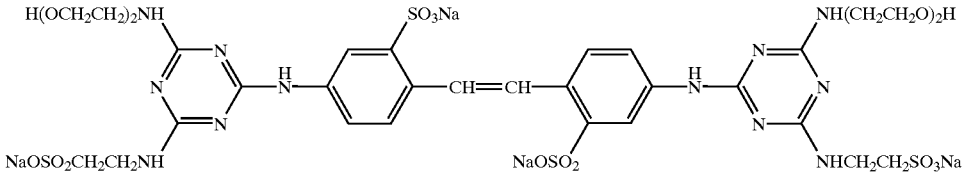

FL-1

Example 6

Using the samples (501) to (526), an image was formed by laser scan-exposure.

As the laser light source, a laser light source having a wavelength of 473 nm which was taken from a YAG solid state laser (oscillation wavelength: 946 nm), using a semiconductor laser GaAlAs (oscillation wavelength: 808.5 nm) as the exciting light source, by wavelength conversion using an SHG crystal of $LiNbO_3$ having a reversal domain structure, a laser light source having a wavelength of 532 nm which was taken from a $YVO_4$ solid state laser (oscillation wavelength: 1064 nm), using a semiconductor laser GaAlAs (oscillation wavelength: 808.7 nm) as the exciting light source, by wavelength conversion using an SHG crystal of $LiNbO_3$ having a reversal domain structure, and AlGaInP (oscillation wavelength: about 680 nm: Type No. LN9R20, manufactured by Matsushita Electric Industrial) were used. The laser lights having three colors respectively were designed to move in a direction perpendicular to the scanning direction by a polygon mirror so that these lights could be applied to the sample in order by scan-exposure. The temperature was kept constant by making use of a Peltier element thereby restricting a variation in the quantity of light caused by the temperature of the semiconductor laser. The effective beam diameter was 80 $\mu$m, the scanning pitch was 42.3 $\mu$m (600 dpi) and the average exposure time per one pixel was $1.7\times10^{-7}$ seconds.

In succession to the exposure, the sample was treated according to the color development processing B. Each sample showed the same behavior as in the case of the high illuminance exposure used in Example 5. It was therefore confirmed that the sample of the present invention was suitable for the formation of an image using laser scan-exposure.

Preferred typical embodiments of the present invention will be described hereinbelow.

Embodiment 1

A silver halide emulsion comprising high silver chloride particles which are provided with a continuous outermost layer containing 30 mol % or more of a silver bromide and have a silver chloride content of 95 mol % or more and a silver iodide content of 0.05 mol % to 0.75 mol %, wherein a compound of an VIII metal of the periodic table is allowed to exist in a zone which is the center of the outermost layer and is limited within 10% to 90% of the volume of the outermost layer.

Embodiment 2

A silver halide emulsion comprising high silver chloride particles which are tabular particles wherein particles occupying 50% or more of the total projected area have an aspect ratio of 2.0 or more, are provided with a continuous outermost layer containing 30 mol % or more of a silver bromide and have a silver chloride content of 95 mol % or more and a silver iodide content of 0.05 mol % to 0.75 mol %, wherein a compound of an VIII metal of the periodic table is allowed to exist in a zone which is the center of the outermost layer and is limited within 10% to 90% of the volume of the outermost layer.

Embodiment 3

A silver halide emulsion comprising high silver chloride particles which are tabular particles wherein particles occupying 50% or more of the total projected area have a {111} principal plane and have an aspect ratio of 2.0 or more, are provided with an outermost layer containing 30 mol % or more of a silver bromide and have a silver chloride content of 95 mol % or more and a silver iodide content of 0.05 mol % to 0.75 mol %, wherein a compound of an VIII metal of the periodic table is allowed to exist in a zone which is the center of the outermost layer and is limited within 10% to 90% of the volume of the outermost layer.

Embodiment 4

A silver halide emulsion according to any one of Embodiments 1 to 3, wherein the volume of the outermost layer is 10% or less of the total volume of the particle.

Embodiment 5

A silver halide emulsion according to any one of Embodiments 1 to 4, wherein the content of silver bromide in the outermost layer is 50 mol % or more.

Embodiment 6

A silver halide emulsion according to any one of Embodiments 1 to 5, wherein the metal of the compound of the VIII metal of the periodic table is iridium.

Embodiment 7

A silver halide emulsion according to any one of Embodiments 1 to 6, wherein the content of silver iodide is 0.1 mol % to 0.5 mol %.

Embodiment 8

A silver halide emulsion according to any one of Embodiments 1 to 7, wherein a region in which the local content of silver iodide is 0.5 mol % to 5 mol % exists.

Embodiment 9

A silver halide emulsion according to any one of Embodiments 1 to 8, wherein the region in which the local content of silver iodide is 0.5 mol % to 5 mol % is disposed adjacent to the outermost layer.

Embodiment 10

A silver halide emulsion according to any one of Embodiments 1 to 9, wherein silver bromide is contained only in the outermost layer.

Embodiment 11

A silver halide emulsion according to any one of Embodiments 1 to 10, wherein the content of silver bromide in the total particles is 0.1 mol % to 2 mol %.

Embodiment 12

A silver halide emulsion according to any one of Embodiments 1 to 11, wherein the silver halide emulsion is a {111} tabular emulsion produced through a step of making a crystal phase control agent fall away.

Embodiment 13

A silver halide color photographic light-sensitive material comprising at least a silver halide emulsion layer containing a yellow dye-forming coupler, a silver halide emulsion layer containing a magenta dye-forming coupler and a silver halide emulsion layer containing a cyan dye-forming coupler on a support, wherein at least one of these silver halide emulsion layers contains the silver halide emulsion according to any one of Embodiments 1 to 12.

Embodiment 14

An image forming method comprising scan-exposing a silver halide color photographic light-sensitive material and thereafter performing color-development processing, the silver halide color photographic light-sensitive material is the silver halide color photographic light-sensitive material according to Embodiment 13.

Embodiment 15

An image forming method according to Embodiment 14, wherein the time required for the color development processing is 20 seconds or less.

Embodiment 16

An image forming method according to Embodiment 14 or Embodiment 15, wherein the scan exposure is carried out using visible laser beam light applied for 10-4 seconds or less to each pixel.

What is claimed is:

1. A silver halide emulsion comprising high silver chloride particles, the high silver chloride particles having a continuous outermost layer containing at least 30 mol % of silver bromide, the high silver chloride particles having a silver chloride content of at least 95 mol % and a silver iodide content of 0.05 mol % to 0.75 mol %, wherein the outermost layer has a center portion, the center portion being limited to a region within 10% to 90% of the volume of the outermost layer, the center portion having present therein a compound of a metal from column VIII of the periodic table.

2. The silver halide emulsion of claim 1, wherein the content of silver bromide in the outermost layer is 40 mol % to 90 mol %.

3. The silver halide emulsion of claim 1, wherein the volume of the outermost layer is 0.1% to 10% of the total volume of the particles.

4. The silver halide emulsion of claim 1, wherein a position at which the compound of the metal from column VIII of the periodic table is present occupies 20% to 80% of the volume of the outermost layer.

5. A silver halide color photographic light-sensitive material comprising a support having disposed thereon at least a silver halide emulsion layer containing a yellow dye-forming coupler, a silver halide emulsion layer containing a magenta dye-forming coupler and a silver halide emulsion layer containing a cyan dye-forming coupler, wherein at least one of the silver halide emulsions comprises high silver chloride particles, the high silver chloride particles having a continuous outermost layer containing at least 30 mol % of silver bromide, the high silver chloride particles having a silver chloride content of at least 95 mol % and a silver iodide content of 0.05 mol % to 0.75 mol %, wherein the outermost layer has a center portion, the center portion being limited to a region within 10% to 90% of the volume of the outermost layer, the center portion having present therein a compound of a metal from column VIII of the periodic table.

6. The silver halide color photographic light-sensitive material of claim 5, wherein the content of silver bromide in the outermost layer is 40 mol % to 90 mol %.

7. The silver halide color photographic light-sensitive material of claim 5, wherein the volume of the outermost layer is 0.1% to 10% of the total volume of the particles.

8. The silver halide color photographic light-sensitive material of claim 5, wherein a position at which the compound of the metal from column VIII of the periodic table is present occupies 20% to 80% of the volume of the outermost layer.

9. An image forming method comprising scan-exposing a silver halide color photographic light-sensitive material and thereafter conducting color development processing, the silver halide color photographic light-sensitive material comprising a support having disposed thereon at least a silver halide emulsion layer containing a yellow dye-forming coupler, a silver halide emulsion layer containing a magenta dye-forming coupler and a silver halide emulsion layer containing a cyan dye-forming coupler, wherein at least one of the silver halide emulsions comprises high silver chloride particles, the high silver chloride particles having a continuous outermost layer containing at least 30 mol % of silver bromide, the high silver chloride particles having a silver chloride content of at least 95 mol % and a silver iodide content of 0.05 mol % to 0.75 mol %, wherein the outermost layer has a center portion, the center portion being limited to a region within 10% to 90% of the volume of the outermost layer, the center portion having present therein a compound of a metal from column VIII of the periodic table.

10. The image forming method of claim 9, wherein time required for conducting the color development processing is no longer than 20 seconds.

11. The image forming method of claim 10, wherein the scan-exposure is conducted by a visible laser beam for no more than $10^{-4}$ seconds per pixel.

* * * * *